US008578872B1

(12) United States Patent
Spellacy

(10) Patent No.: US 8,578,872 B1
(45) Date of Patent: Nov. 12, 2013

(54) LIFE VESSEL RETRIEVAL SYSTEM

(75) Inventor: Richard Alfred Spellacy, St. John's (CA)

(73) Assignee: Offshore Marine Rescue Corporation, St. John's, NL (CA)

( * ) Notice: Subject to any disclaimer, the term of this patent is extended or adjusted under 35 U.S.C. 154(b) by 230 days.

(21) Appl. No.: 13/080,331

(22) Filed: Apr. 5, 2011

Related U.S. Application Data

(60) Provisional application No. 61/320,890, filed on Apr. 5, 2010.

(51) Int. Cl.
*B63B 35/40* (2006.01)

(52) U.S. Cl.
USPC ..... 114/259; 114/249; 114/253; 114/258

(58) Field of Classification Search
USPC ..... 114/244, 249, 254, 258, 259, 260, 375, 114/253
See application file for complete search history.

(56) References Cited

U.S. PATENT DOCUMENTS

| | | | | |
|---|---|---|---|---|
| 3,943,875 | A * | 3/1976 | Sanders | 114/259 |
| 6,431,105 | B2 | 8/2002 | Haram | |
| 6,843,198 | B1 * | 1/2005 | Witbeck | 114/258 |
| 7,156,036 | B2 | 1/2007 | Seiple | |
| 7,347,157 | B2 | 3/2008 | Seiple | |
| 7,350,475 | B2 | 4/2008 | Borgwarth et al. | |

* cited by examiner

*Primary Examiner* — Lars A Olson
(74) *Attorney, Agent, or Firm* — Bereskin & Parr LLP/S.E.N.C.R.L., s.r.l.

(57) ABSTRACT

A system for retrieving a life vessel from water and drawing the life vessel onto a deck of a rescue vessels comprises a life vessel system comprising: i) a tow-line comprising a first end portion secured to the life vessel and an opposed second end portion; and ii) a deployment system configured to deploy the second end portion of the tow-line into the water. The system further comprises a rescue vessel system comprising i) a towing device on the rescue vessel, the towing device configured to receive the second end portion of the tow-line and retract the tow-line to draw the life vessel towards the rescue vessel; and ii) a retrieval assembly assembled to the deck of the rescue vessel, the retrieval assembly configured to receive the life vessel as the life vessel is drawn towards the rescue vessel and to lift the rescue vessel onto the deck.

19 Claims, 27 Drawing Sheets

LIFE VESSEL RETRIEVAL SYSTEM

FIELD

The disclosure relates to systems and method for retrieving a life vessel from water and drawing the life vessel onto the deck of a rescue vessel.

INTRODUCTION

The following is not an admission that anything discussed below is prior art or part of the common general knowledge of persons skilled in the art.

U.S. Pat. No. 6,431,105 (Haram) discloses a method for bringing people in life boats in the sea aboard a support vessel, in which a rescue craft is launched from a ramp in the stern of the support vessel. The rescue craft carries a rope from a winch in front of the ramp. The rope is attached to a life boat in the sea. The life boat is hauled onto the ramp by the winch and the life boat is emptied. Also disclosed is a support vessel for launching and recovery of rescue crafts and life boats including a stern ramp for launching and entering of rescue crafts and life boats, and a winch for hauling the rescue crafts and life boats onto the ramp.

SUMMARY

The following summary is provided to introduce the reader to the more detailed discussion to follow. The summary is not intended to limit or define the claims.

According to one aspect, a system for retrieving a life vessel from water and drawing the life vessel onto a deck of a rescue vessel is provided. The system comprises a life vessel system comprising: i) a tow-line comprising a first end portion secured to the life vessel and an opposed second end portion; and ii) a deployment system configured to deploy the second end portion of the tow-line into the water. The system further comprises a rescue vessel system comprising i) a towing device on the rescue vessel, the towing device configured to receive the second end portion of the tow-line and retract the tow-line to draw the life vessel towards the rescue vessel; and ii) a retrieval assembly assembled to the deck of the rescue vessel, the retrieval assembly configured to receive the life vessel as the life vessel is drawn towards the rescue vessel and to lift the rescue vessel onto the deck. The life vessel system optionally further comprises a housing mounted to the life vessel, and the tow-line is stored within the housing prior to deployment. The deployment system is typically remotely activatable. The deployment system optionally comprises:

a) a receiver stored within the housing and activatable to deploy the second end portion of the tow-line into the water; and b) an activation control on the rescue vessel in wireless communication with the receiver.

The tow-line is optionally a floatable rope. A first and a second control line, are optionally each control line mounted between the life vessel and the tow-line. The first end portion of the tow-line is optionally secured to a forefoot of a keel of the life vessel. The system optionally further comprises a drogue, such as a parachute drogue, mounted to the second end portion of the tow-line. The system optionally further comprises an inflatable buoy mounted to the second end portion of the tow-line. The inflatable buoy is typically inflatable by a seawater-activated $CO_2$ system. The rescue vessel system optionally further comprises a grapnel for retrieving the tow-line from the water. The system optionally further comprises a pneumatic line throwing gun for throwing the grapnel into the water towards the tow-line. The towing device optionally comprises a winch.

The retrieval assembly optionally comprises:

c) a fulcrum assembled to the deck of the rescue vessel proximate a stern of the rescue vessel;

d) a rail comprising a first end portion and a second end portion, the rail mounted to the fulcrum and pivotable thereabout to lower the first end of the rail off of the stern into the water;

e) a sled mounted to the rail, the sled securable to the life vessel and slideable along the rail from the first end portion of the rail towards the second end portion to lift the life vessel onto the rescue vessel as the towing device draws the life vessel towards the rescue vessel. In the system, optionally:

f) the life vessel system further comprises a life vessel locking assembly secured to the life vessel;

g) the sled comprises a sled locking assembly; and h) the life vessel locking assembly is lockable to the sled locking assembly to secure the life vessel to the sled.

The life vessel locking assembly is optionally mounted to a forefoot of a keel of the life vessel. The first end portion of the tow-line is optionally secured to the life vessel locking assembly. The life vessel locking assembly is typically configured to automatically lock to the sled locking assembly as the towing device draws the life vessel towards the rescue vessel. Optionally in the system:

i) the sled locking assembly comprises a pair of jaws mounted to the sled;

j) each jaw has a first end positioned towards the first end portion of the rail, and a second end positioned away from the second end portion of the rail;

k) the first ends of the jaws define a first opening facing towards the first end portion of the rail, and the second ends of the jaws define a second opening facing towards the second end portion of the rail; and l) the second ends of the jaws are movable towards and away from each other and are biased towards each other.

In the system, optionally:

m) the life vessel locking assembly comprises a shoe extending outwardly from the forefoot of the keel of the life vessel; and n) the shoe comprises a forward surface and a rearward surface defining a shoulder.

The shoe is typically configured to enter the first opening as the towing device draws the life vessel towards the rescue vessel, travel towards the second opening and move the second ends of the jaws away from each other, and exit the second opening such that the second ends of the jaws move back towards each other behind the shoulder and abut the shoulder to secure the life vessel to the sled.

The sled locking assembly optionally further comprises:

o) a rib extending generally transverse to the jaws and positioned outboard of the second ends of the jaws in a direction towards the second end portion of the rail, and p) a bearing surface positioned above the rib, the bearing surface moveable towards and away from the rib and biased towards the rib.

Optionally, the shoe further comprises a groove extending upwardly into the shoe from a lower surface thereof and extending laterally across the shoe. The rib is typically receivable in the groove and the bearing surface is bearable against the shoe to maintain the rib in the groove and to further secure the life vessel to the sled. The first end portion of the tow-line is typically secured to an eye of the shoe. The retrieval assembly optionally further comprises a pair of life vessel supports mountable to the rail on opposed sides of the rail, wherein the life vessel is receivable between the supports and supported thereby when the life vessel is locked to the sled.

The rail optionally comprises:

q) an H-beam comprising a generally horizontal lower wall, at least one generally horizontal upper wall and at least one generally vertical connecting wall extending between the lower wall and the upper wall;

r) a T-beam extending from the H-beam, the T-beam comprising at least one generally vertical spacing wall extending upwardly from the upper wall, and at least one generally horizontal top wall extending from the spacing wall, the top wall defining a sled-support.

The sled is typically seatable on the sled-support and slideable therealong. The sled optionally comprises a base wall seatable on the sled-support, and a pair of stabilizer walls extending downwardly and from the base wall and inwardly between the upper wall and sled-support. An upper surface of the sled-support is typically coated with a low-friction material, comprising a material such as high density polyethylene. The rescue vessel system is typically dissasemblable from the rescue vessel. The life vessel system is typically removable from the life vessel.

According to another aspect, a life vessel system of a life vessel retrieval system is provided. The life vessel system is secured to a life vessel and comprises a) a tow-line comprising a first end portion secured to the life vessel and an opposed second end portion; and b) a deployment system remotely activatable to deploy the second end portion of the tow-line into water.

The life vessel system optionally further comprises a housing mounted to the life vessel, and the tow-line is stored within the housing prior to deployment. The deployment system optionally comprises:

a) a receiver stored within the housing and activatable to deploy the second end portion of the tow-line into the water; and b) an activation control in wireless communication with the receiver.

The tow-line is typically a floatable rope. The life vessel system optionally further comprises a first and a second control line, each control line mounted between the life vessel and the tow-line. The first end portion of the tow-line is optionally secured to a forefoot of a keel of the life vessel. The life vessel system optionally further comprises a drogue, such as a parachute drogue, mounted to the second end portion of the tow-line. The life vessel system optionally further comprises an inflatable buoy mounted to the second end portion of the tow-line, such as an inflatable buoy is inflatable by a seawater-activated $CO_2$ system. The life vessel system optionally further comprises a life vessel locking assembly secured to the life vessel, the life vessel locking assembly lockable to a retrieval assembly of a rescue vessel. The life vessel locking assembly is optionally mounted to a forefoot of a keel of the life vessel. The first end portion of the tow-line is optionally secured to the life vessel locking assembly. The life vessel locking assembly is optionally configured to automatically lock to the retrieval assembly of the rescue vessel when brought into contact with the retrieval assembly of the rescue vessel.

In the life vessel system, optionally:

c) the life vessel locking assembly comprises a shoe extending outwardly from the forefoot of the keel of the life vessel; and d) the shoe comprises a forward surface and a rearward surface defining a shoulder.

In the life vessel system, optionally the shoulder is engageable with a pair of jaws of the retrieval assembly to secure the life vessel to the sled. The shoe optionally further comprises a groove extending upwardly into the shoe from a lower surface thereof and extending laterally across the shoe. The groove is typically configured to receive a rib of the retrieval assembly. The tow-line is typically secured to the eye of the shoe. The life vessel system is optionally removably secured to the life vessel.

According to another aspect, a rescue vessel system of a life vessel retrieval system is provided. The rescue vessel system is assembled to a rescue vessel and comprises a towing device secured to the rescue vessel. The towing device is configured to receive a tow-line secured to a life vessel and retract the tow-line to draw the life vessel towards the rescue vessel. The rescue vessel system further comprises a retrieval assembly assembled to the deck of the rescue vessel. The retrieval assembly is configured to receive the life vessel as the life vessel is drawn towards the rescue vessel and to lift the rescue vessel onto the deck.

The rescue vessel system optionally further comprises a grapnel for retrieving the tow-line from water. The rescue vessel system optionally further comprises a pneumatic line throwing gun for throwing the grapnel into the water towards the tow-line. The towing device optionally comprises a winch. The rescue vessel system optionally comprises:

a) a fulcrum assembled to the deck of the rescue vessel proximate a stern of the rescue vessel;

b) a rail comprising a first end portion and a second end portion, the rail mounted to the fulcrum and pivotable thereabout to lower the first end of the rail off of the stern into the water;

c) a sled mounted to the rail, the sled securable at or below gunnels of the life vessel and slideable along the rail from the first end portion of the rail towards the second end portion to lift the life vessel onto the rescue vessel as the towing device draws the live vessel towards the rescue vessel.

The sled optionally comprises a sled locking assembly lockable the life vessel to secure the life vessel to the sled. The sled locking assembly is optionally configured to automatically lock to the life vessel as the towing device draws the life vessel towards the rescue vessel. In the rescue vessel system, optionally:

d) the sled locking assembly comprises a pair of jaws mounted to the sled;

e) each jaw has a first end positioned towards the first end portion of the rail, and a second end positioned away from the second end portion of the rail;

f) the first ends of the jaws define a first opening facing towards the first end portion of the rail, and the second ends of the jaws define a second opening facing towards the second end portion of the rail; and g) the second ends of the jaws are movable towards and away from each other and are biased towards each other.

Optionally, the first opening is configured to receive a shoe of a life vessel locking assembly, the second end of the jaws are configured to move away from each other as the shoe passes through the jaws towards the second opening, and to move back towards each other when the shoe passes through the second opening. The second ends of the jaws optionally engage the shoe to secure the life vessel to the sled. The wherein the sled locking assembly optionally further comprises:

h) a rib extending generally transverse to the jaws and positioned outboard of the second ends of the jaws in a direction towards the second end portion of the rail, and i) a bearing surface positioned above the rib, the bearing surface moveable towards and away from the rib and biased towards the rib.

In the rescue vessel system the rib is optionally receivable in a groove of the shoe and the bearing surface is bearable against the shoe to maintain the rib in the groove and to further secure the life vessel to the sled. The retrieval assembly optionally further comprises a pair of life vessel supports mountable to the rail on opposed sides of the rail, the pair of supports configured to receive the life vessel therebetween and support the life vessel when the sled is secured to the life vessel. In the rescue vessel system the rail optionally comprises:

j) an H-beam comprising a generally horizontal lower wall, at least one generally horizontal upper wall and at least one generally vertical connecting wall extending between the lower wall and the upper wall;

k) a T-beam extending from the H-beam, the T-beam comprising at least one generally vertical spacing wall extending upwardly from the upper wall, and at least one generally horizontal top wall extending from the spacing wall, the top wall defining a sled-support.

The sled is optionally seatable on the sled-support and slideable therealong. The sled optionally comprises a base wall seatable on the sled-support, and a pair of stabilizer walls extending downwardly and from the base and inwardly between the upper wall and sled-support. An upper surface of the sled-support is optionally coated with a low-friction material, the material optionally comprising high density polyethylene. The rescue vessel system is optionally dissasemblable from the rescue vessel.

According to another aspect, a method for retrieving a life vessel and drawing the life vessel onto a deck of a rescue vessel is provided. The method comprises a) deploying a tow-line from the life vessel into water, the tow-line comprising a first end portion secured to the life vessel; b) retrieving the tow-line from the water and securing the tow-line to a towing device of the rescue vessel; and c) towing the life vessel onto a deck of the rescue vessel.

Optionally, step (a) comprises wirelessly deploying the tow-line from the rescue vessel using an activation control on the rescue vessel. The method optionally further comprising utilizing a drogue attached to the tow-line to align the life vessel head-to-sea. Step (b) optionally comprises activating a pneumatic line-throwing gun to launch a grapnel from the rescue vessel over the tow-line. Step (b) optionally further comprises pulling the grapnel back towards the rescue vessel while hooking the grapnel to the tow-line. The method optionally further comprises assembling a retrieval assembly to a deck of the rescue vessel by:

a) assembling a fulcrum to the deck of the rescue vessel proximate a stern of the rescue vessel;

b) mounting a rail to the fulcrum, the rail comprising a first end portion and an opposed second end portion, pivoting the rail about the fulcrum such that the first end portion is in the water and the second end portion is above the deck;

c) mounting a sled to the rail such that the sled is slideable along the rail from the first end portion of the rail towards the second end portion; and d) positioning the sled at the first end portion of the rail.

Step (b) optionally comprises feeding the tow-line through the retrieval assembly. Step (c) optionally comprises towing the life vessel towards the first end portion of the rail. Step (c) optionally further comprises towing the life vessel onto the sled and locking the life vessel to the sled. Optionally, step (c) further comprises towing the life vessel and the sled along the rail from the first end portion of the rail to the second end portion of the rail. Typically, step (c) further comprises stabilizing the life vessel as the life vessel is towed along the rail. Typically, step (c) further comprises pivoting the first end of the rail out of the water and the second end portion of the rail back towards the deck after the life vessel is on the rail. Step (c) optionally further comprises passively allowing the rail to pivot due to the weight of the life vessel as the life vessel is towed along the rail.

According to another aspect, a method for retrieving a life vessel and drawing the life vessel onto a deck of a rescue vessel is provided. The rescue vessel comprises a retrieval assembly assembled to a deck thereof. The retrieval assembly comprises a fulcrum assembled to the deck of the rescue vessel proximate a stern of the rescue vessel. The retrieval assembly further comprises a rail comprising a first end portion and a second end portion. The rail is mounted to the fulcrum and pivoted thereabout such that the first end of portion of the rail is positioned in water. The retrieval assembly further comprises a sled mounted to the rail and positioned at the first end portion of the rail. The method comprises a)

securing a tow-line between the life vessel and the rescue vessel; b) towing the life vessel towards the sled and securing the life vessel to the sled; and c) towing the sled and the life vessel along the rail from the first end portion of the rail towards the second end portion of the rail; and d) pivoting the first end of the rail out of the water and the second end portion of the rail back towards the deck.

Step (a) optionally comprises deploying a tow-line from the life vessel into the water, the tow-line comprising a first end portion secured to the life vessel. Step (a) optionally comprises wirelessly deploying the tow-line from the rescue vessel using an activation control on the rescue vessel. Step (a) optionally further comprises activating a pneumatic line-throwing gun to launch a grapnel from the rescue vessel towards the tow-line. Step (a) optionally further comprises pulling the grapnel back towards the rescue vessel while hooking the grapnel to the tow-line. Step (a) optionally further comprises securing the tow-line to a winch on the rescue vessel. Step (c) optionally further comprises stabilizing the life vessel as the life vessel is towed along the rail. Step (d) optionally comprises passively allowing the rail to pivot due to the weight of the life vessel as the life vessel is towed along the rail.

DRAWINGS

Reference is made in the detailed description to the accompanying drawings, in which.

Figure 26:
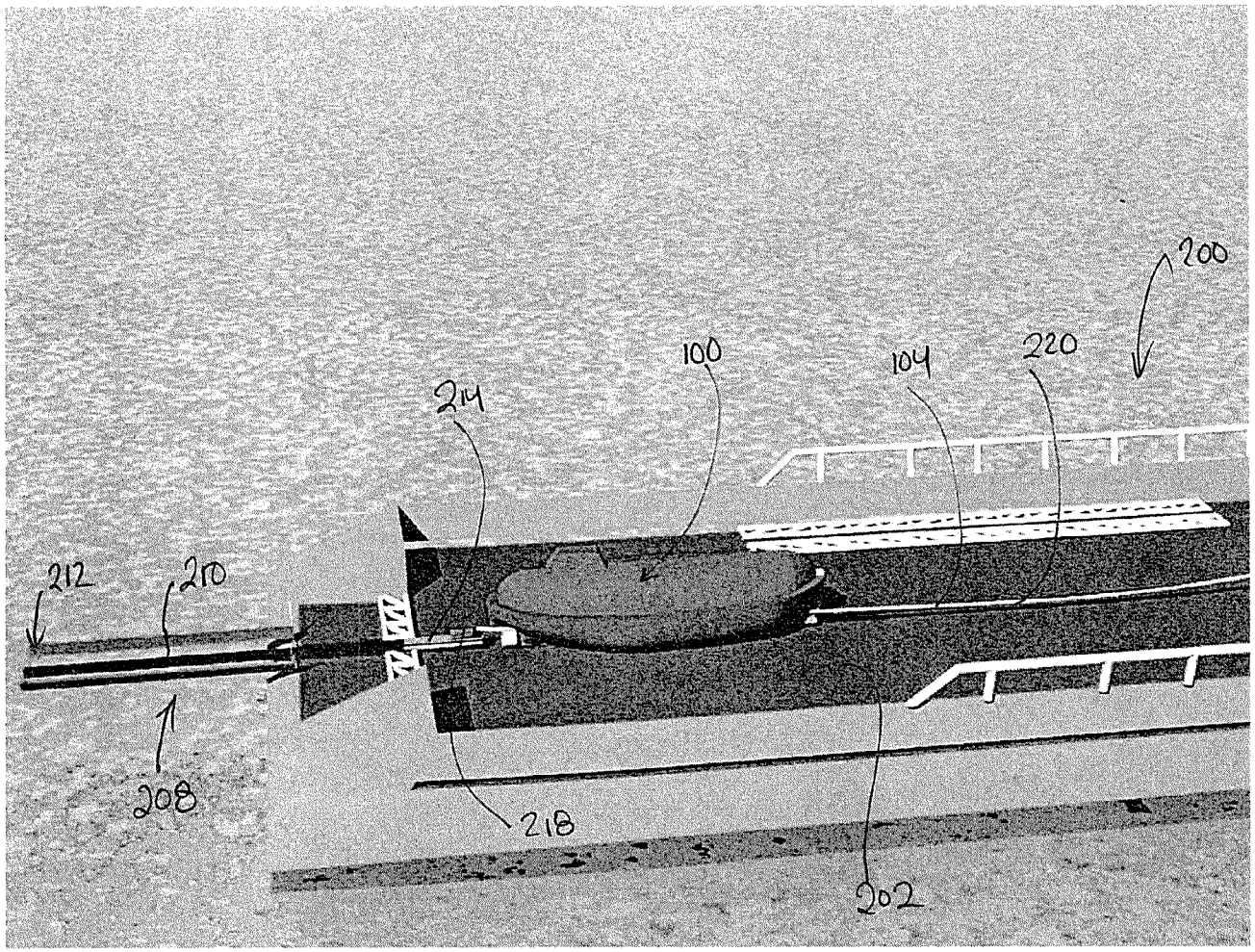
FIG. 26 is a perspective illustration of the life vessel and rescue vessel of FIG. 22, showing the life vessel disassembled from the sled.
Figure 27:
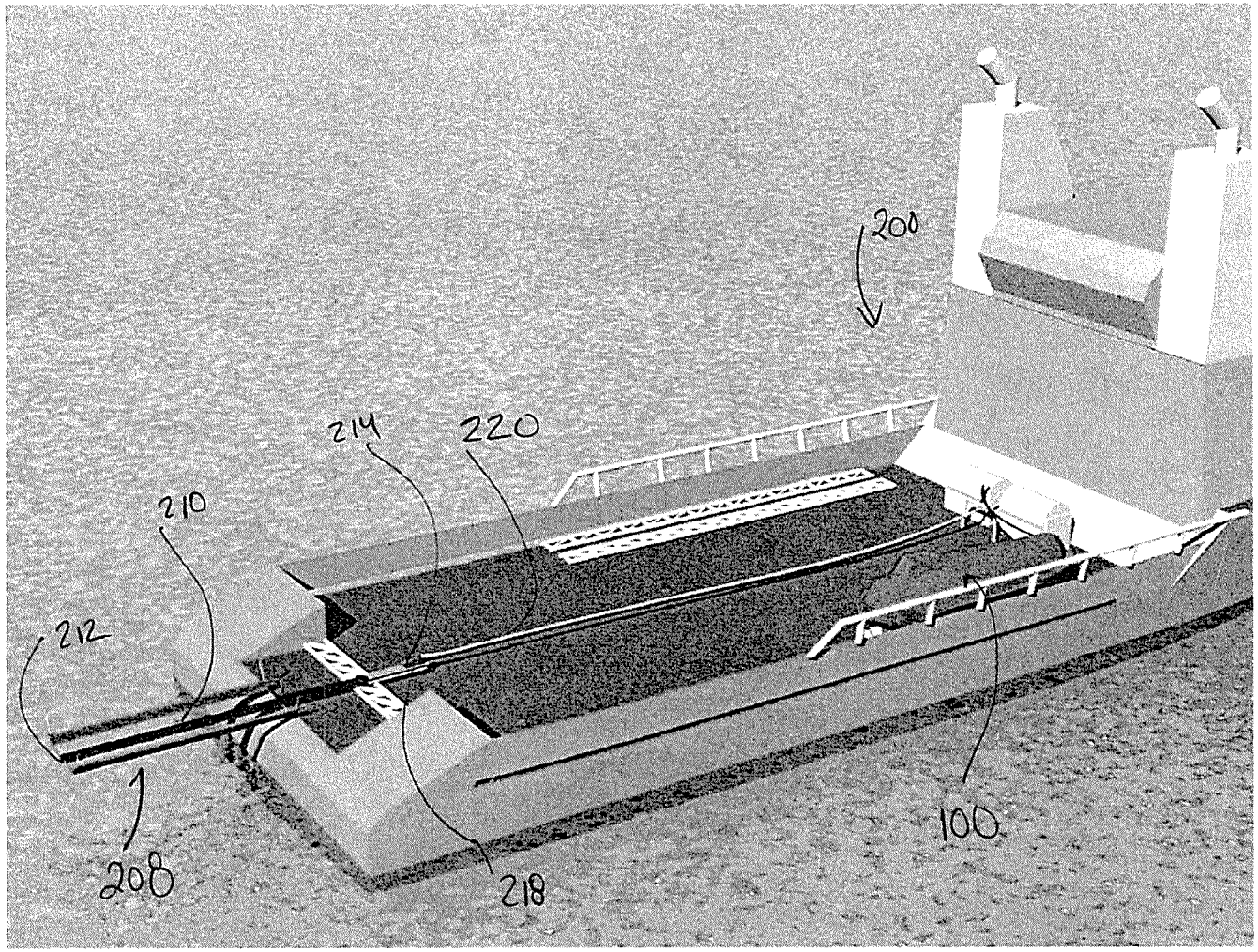
Figure 28:
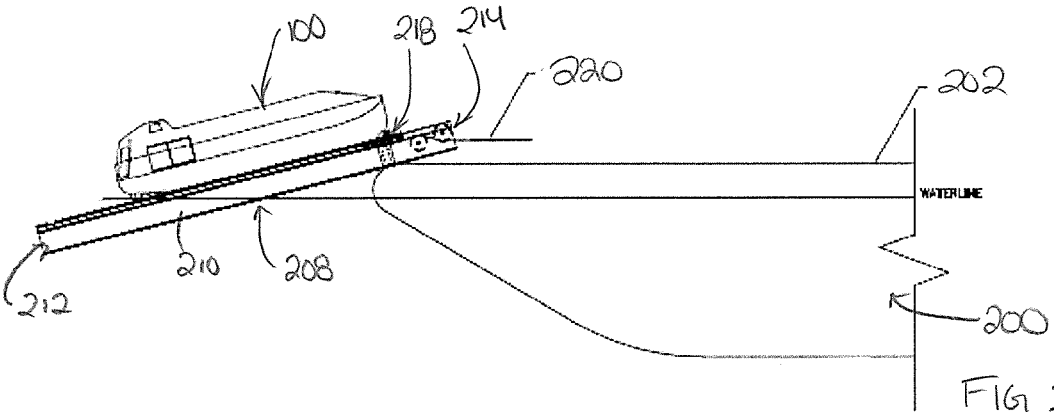
Figure 29:
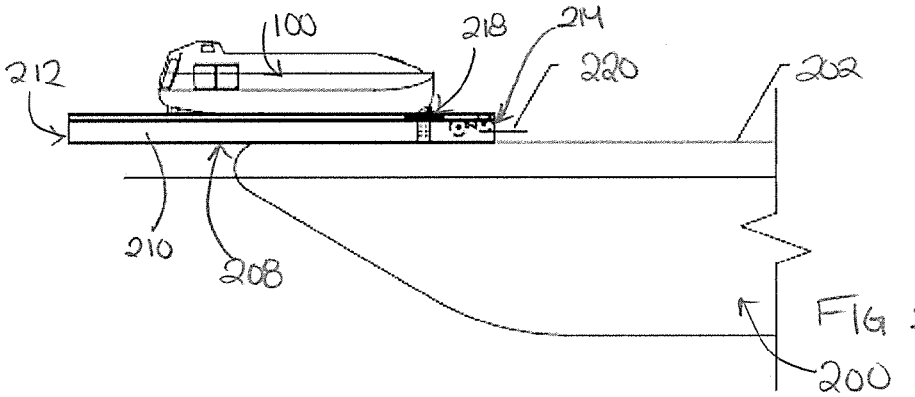
Figure 30:
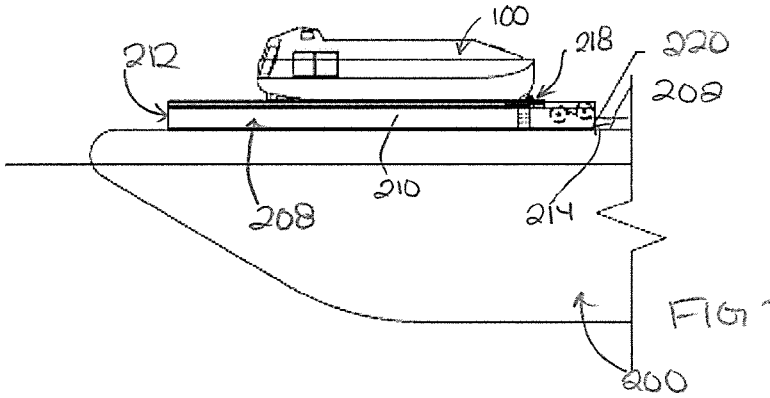

FIG. 27 is a perspective illustration of the life vessel and rescue vessel of FIG. 26, showing the life vessel stowed on the deck of the rescue vessel; and FIGS. 28 to 30 are plan view of an alternate life vessel and rescue vessel, showing an alternate series of steps for pivoting a rail to a horizontal position and bringing the retrieval assembly and life vessel onto the deck of the rescue vessel.

DETAILED DESCRIPTION

Figure 1:
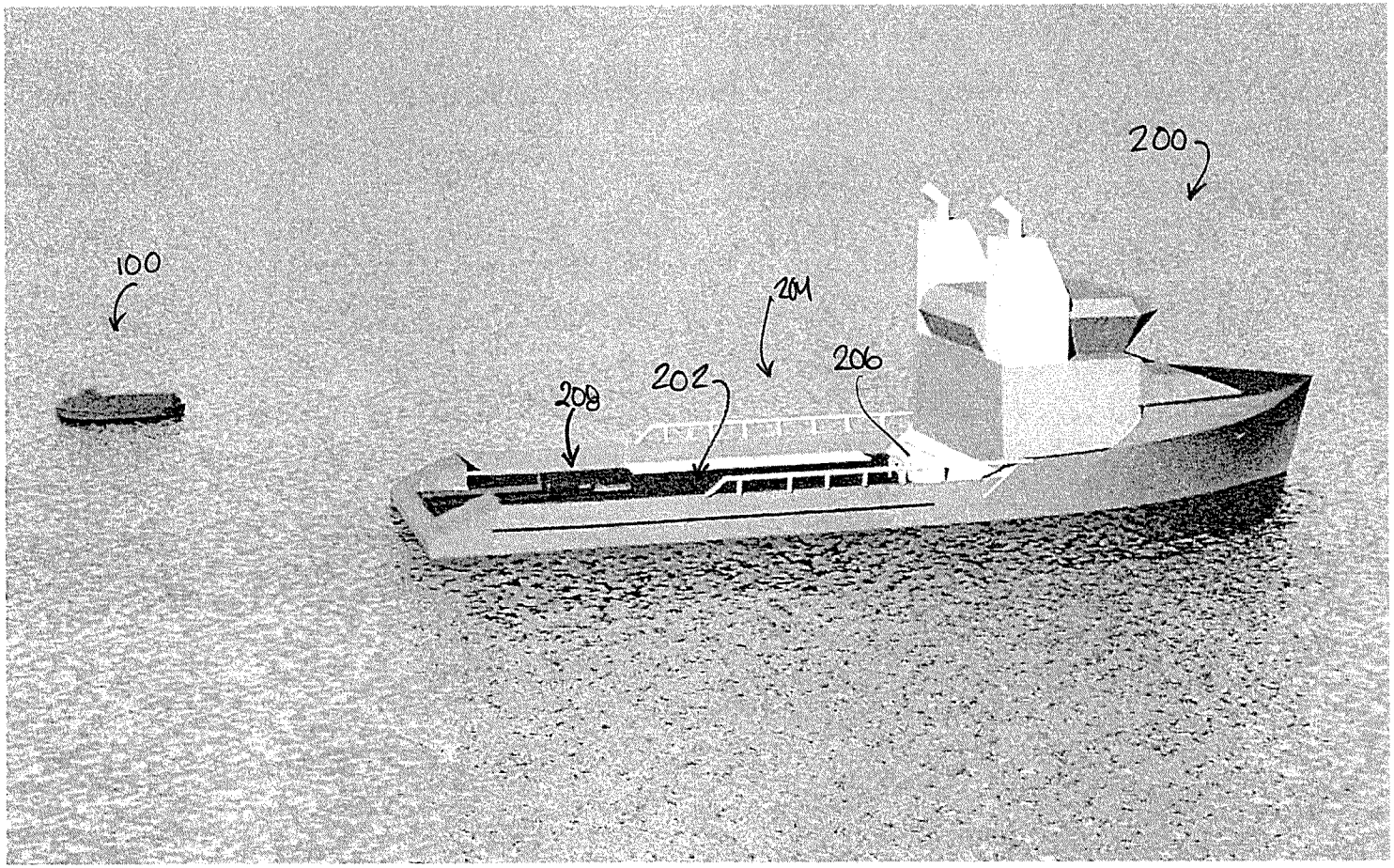
FIG. 1 is a perspective illustration of a life vessel and rescue vessel in water.

Referring to FIG. 1, an example of a life vessel 100 and a rescue vessel 200 is shown. The life vessel 100 may, for example, have been deployed from a sinking or damaged vessel, and may have one or more passengers aboard. An exemplary system is disclosed herein for retrieving the life vessel from the water, and drawing the life vessel on to the deck 202 of the rescue vessel 200. As will be described in further detail below, the system includes a life vessel system 102, which is assemblable to the life vessel 100, and a rescue vessel system 204, which is assemblable to the rescue vessel 200. The assembled life vessel system 102 and rescue vessel system 204 are engagable to draw the life vessel 100 on to the deck 202 of the rescue vessel 200.

Figures 2A, 2B, 2C:
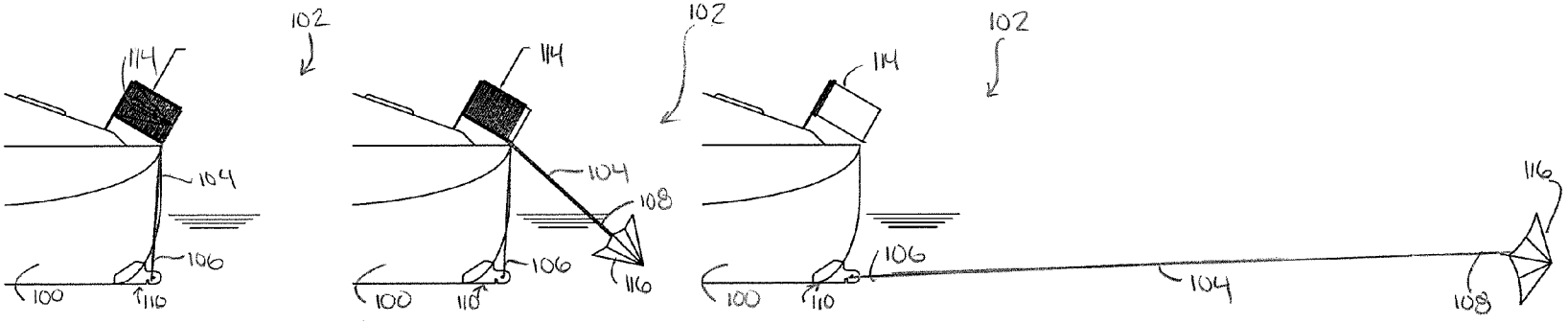
FIG. 2A is a partial plan view of the life vessel of FIG. 1, showing a tow-line in a stored position.
FIG. 2B is a simplified partial plan view of the life vessel of FIG. 1, showing a tow-line in a partially deployed position.
FIG. 2C is a simplified partial plan view of the life vessel of FIG. 1, showing a tow-line in a deployed position.

Referring to FIGS. 2A to 2C, an example of a life vessel system 102 is shown. The life vessel system 102 may be pre-installed on the life vessel 100, or may be installed when use of the life vessel system 102 is required, and may be removable from the life vessel 100.

Referring still to FIGS. 2A to 2C, the life vessel system 102 includes a tow-line 104. The tow-line may be a brightly colored and floatable rope. The tow-line 104 has a first end portion 106, which is secured to the life vessel 102, and an opposed second end portion 108 (shown in FIGS. 2B and 2C), which is deployable into the water. The first end portion 106 of the tow-line may be secured to the life vessel 100 in any suitable manner. As exemplified in FIGS. 2A to 2C, the life vessel system comprises a life vessel locking assembly 110, which is secured to the forefoot of the keel of the life vessel 100, below the gunnels of the life vessel 100. The life vessel locking assembly 110 will be described in further detail below. The first end portion 106 of the tow-line 104 is secured to the life vessel locking assembly 110.

The second end portion 108 of the tow-line 104 is stored when not in use, as shown in FIG. 2A, and is deployable into the water when in use, as shown in FIGS. 2B and 2C, and as will be described further below. In order to store the second end portion 108 of the tow-line 104, the life vessel system further includes a housing 114 mounted to the life vessel 100. In the example shown, the housing 114 is mounted to the gunnels of the life vessel 100. With reference to FIG. 2A, from the life vessel locking assembly 110, the tow-line 104 is lead towards the housing 114, where the majority of the tow-line 104, including the second end portion 108 of the tow-line 104, is stored prior to deployment.

Referring to FIGS. 2B and 2C, the second end portion 108 of the tow-line 104 has a drogue 116 mounted thereto. The drogue 116 may be any suitable type of drogue, such as a parachute drogue. When the second end portion 108 of the tow-line 104 is deployed into the water, the drogue 116 serves to orient the lifeboat head-to-sea, to control the drift of the lifeboat, as shown in FIG. 2C. The second end portion 108 of the tow-line 104 may further include an inflatable buoy mounted thereto (not shown). The inflatable buoy may be inflated by a seawater activated $CO_2$ system. When inflated, the inflatable buoy may aid in visually identifying the second end portion 108 of the tow-line 104.

The life vessel system 102 may further include first 128 and second 130 control lines (shown in FIG. 9), mounted between the tow-line 104 and the life vessel 100.

As mentioned hereinabove, the second end portion 108 of the tow-line 104 is deployable into the water. In order to deploy the second end portion 108 of the tow-line 104, the life vessel system 102 comprises a deployment system (not shown). The deployment system may be remotely activatable. For example, the deployment system may comprise a receiver and an actuator stored within the housing 114, and an activation control on the rescue vessel 200 in wireless communication with the receiver. When the receiver receives a signal from the activation control, the receiver may send a signal to the actuator, and the actuator may cause the housing 114 to open. When the housing 114 is open, the second end portion 108 of the tow-line 104 may drop into the water, as shown in FIG. 2B. Alternately, rather the dropping the second end portion 108 of the tow-line 104 into the water, a launching system (not shown) may be provided, which may launch the second end portion 108 of the tow-line 104 away from the life vessel 100 and into the water.

Figure 14:
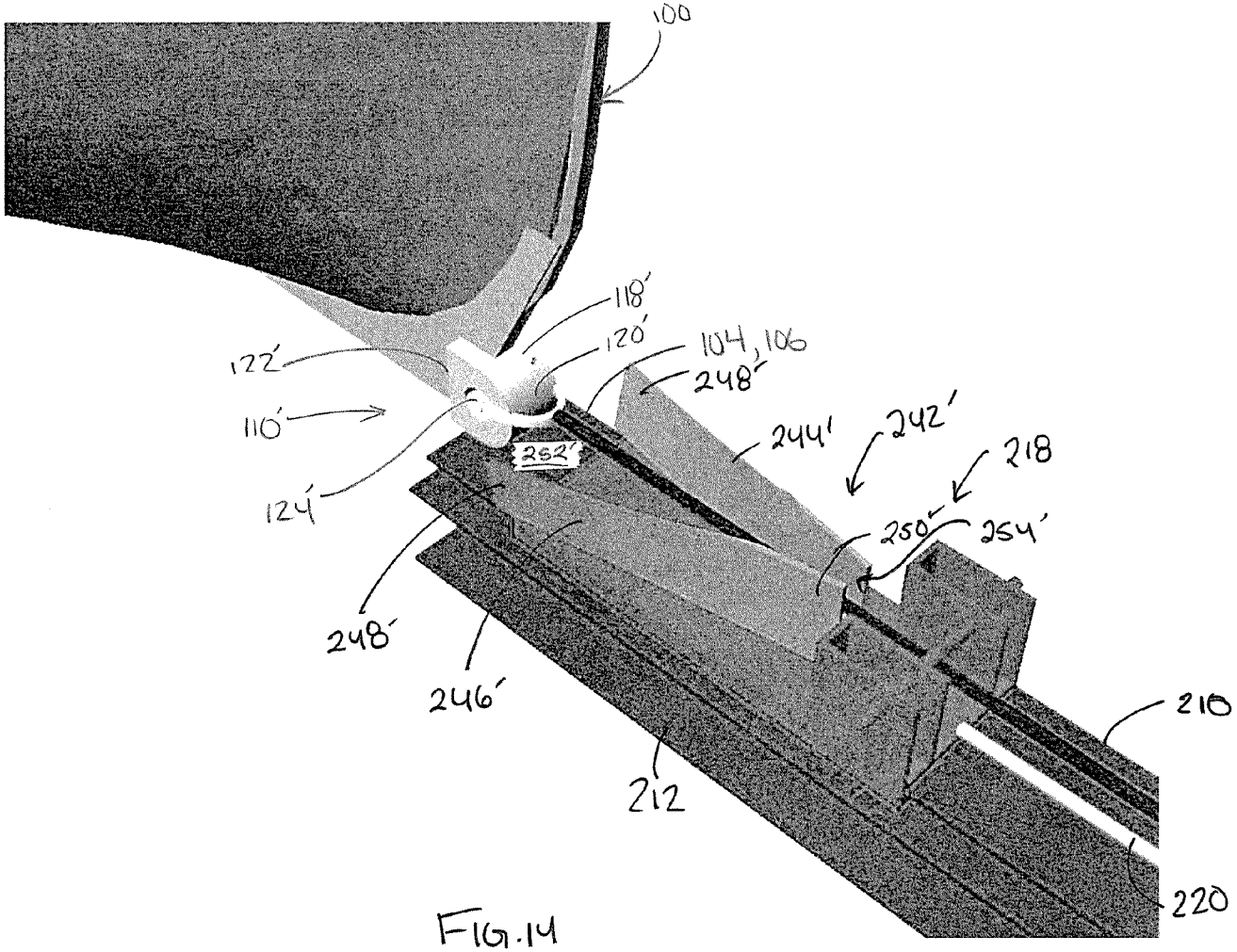
FIG. 14 is an enlarged perspective illustration of the life vessel and rescue vessel in the position of FIG. 13, showing a life vessel locking assembly approaching a sled locking assembly.
Figure 18:
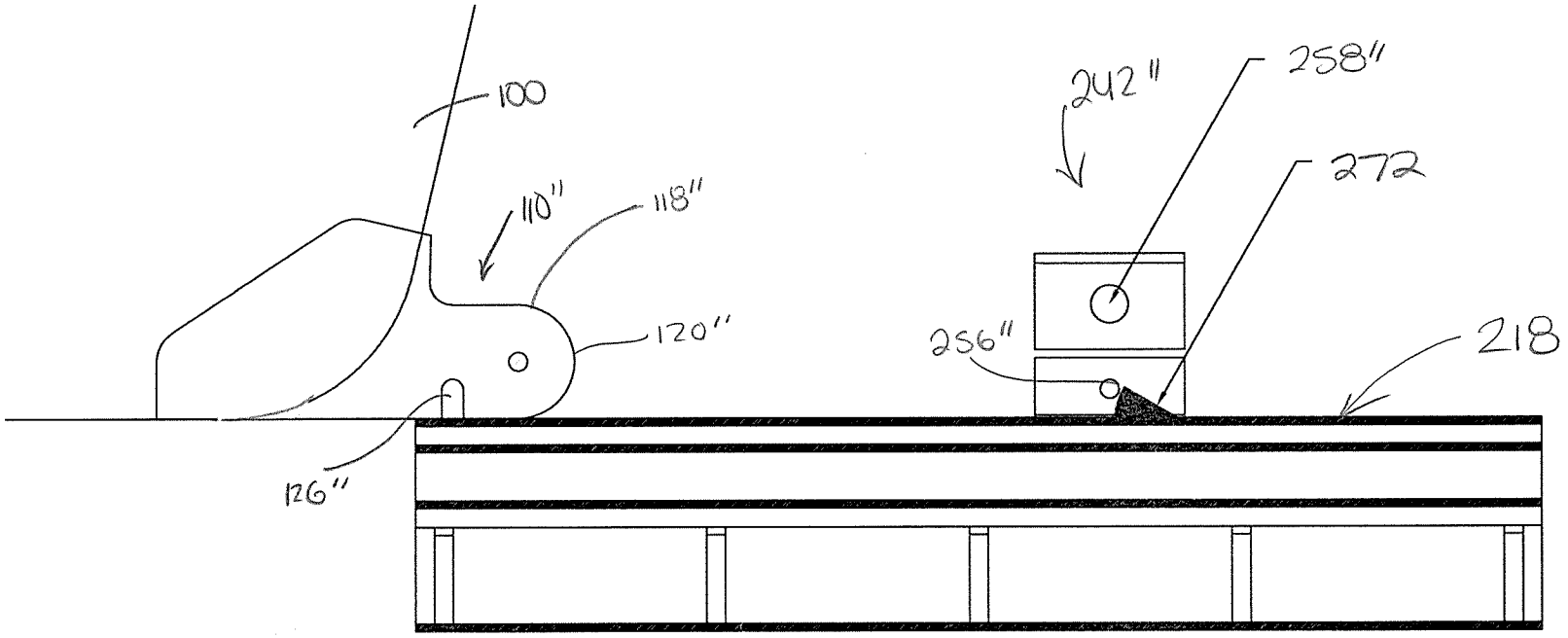
FIG. 18 is a simplified plan view of an alternate life vessel locking assembly approaching an alternate sled locking assembly.

As mentioned hereinabove, the life vessel system 102 comprises a life vessel locking assembly 110, which is secured to the forefoot of the keel of the life vessel 100, and to which the first end portion 106 of the tow-line 104 is secured. The life vessel locking assembly 110 is engagable with the rescue vessel system 200. Referring to FIG. 14, a first example of a life vessel locking assembly 110' is shown. In this example, the life locking assembly 110' comprises a shoe 118' extending outwardly from the forefoot of the keel of the life vessel 100. The shoe 118' comprises a forward surface 120', and a rearward surface 122' defining a shoulder. The shoe further comprises an eye 124', to which the first end portion 106 of the tow-line 104 is attached. Referring to FIG. 18, a second example of a life vessel locking assembly 110" is shown. The life vessel locking assembly 110" is similar to the life vessel locking assembly of FIG. 14 (although the shoulder is not shown in FIG. 18) but further includes a groove 126" extending upwardly into the shoe 118" from a lower surface thereof and extending laterally across the shoe 118". The engagement of the life vessel locking assemblies 110' and 110" and the rescue vessel system 200 will be described in further detail below, Referring now to FIGS. 1 and 3 to 7, an example of a rescue vessel system 204 is shown.

Referring to FIG. 1, the rescue vessel system 204 comprises a towing device 206. As will be described in further detail below, the towing device 206 is configured to receive the second end portion 108 of the tow-line 104, and retract the tow-line 104 to draw the life vessel 100 towards the rescue vessel 200. In the example shown, the towing device 206 is a winch. However, in alternate examples, a towing device may be another type of towing device.

Referring still to FIG. 1, the rescue vessel system 204 further comprises a retrieval assembly 208, which is configured to receive the life vessel 100 as the life vessel 100 is drawn towards the rescue vessel 200, and to lift the life vessel 100 onto the deck 202 of the rescue vessel 200, as will be described in further detail below.

Figure 3:
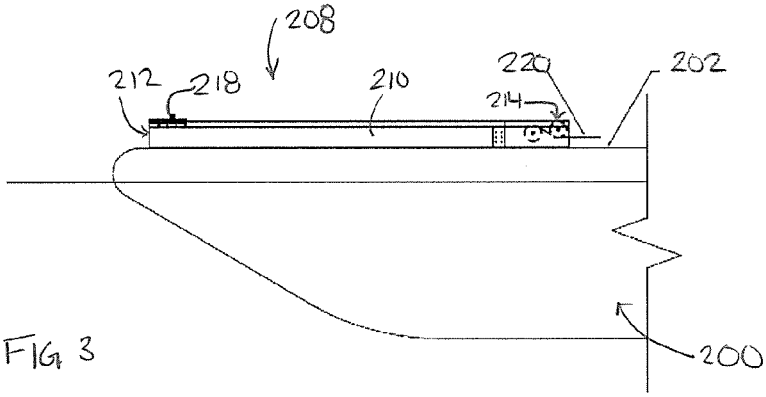
FIG. 3 is a simplified partial plan view of the rescue vessel of FIG. 2, showing a retrieval assembly in a stored configuration.
Figure 4:
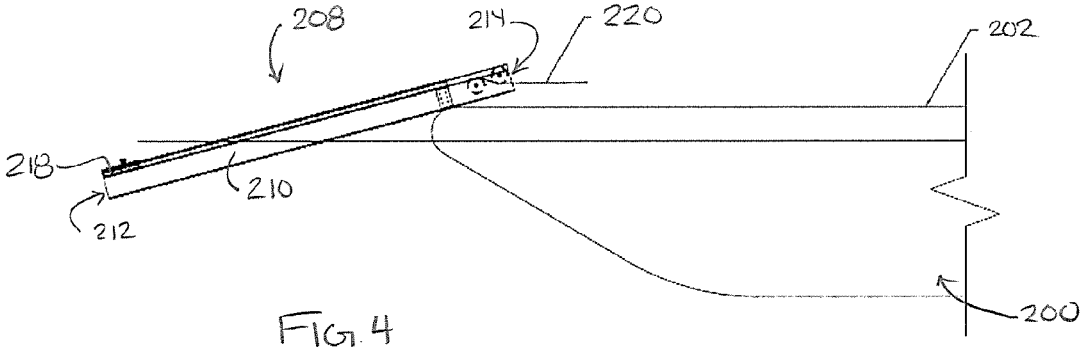
FIG. 4 is a simplified partial plan view of the rescue vessel of FIG. 2, showing a retrieval assembly in an in-use configuration.

The retrieval assembly 208 may be housed on the rescue vessel 200 in a stored position, as shown in FIG. 3, and may be reconfigured to an in-use configuration, shown in FIG. 4.

Figure 5:
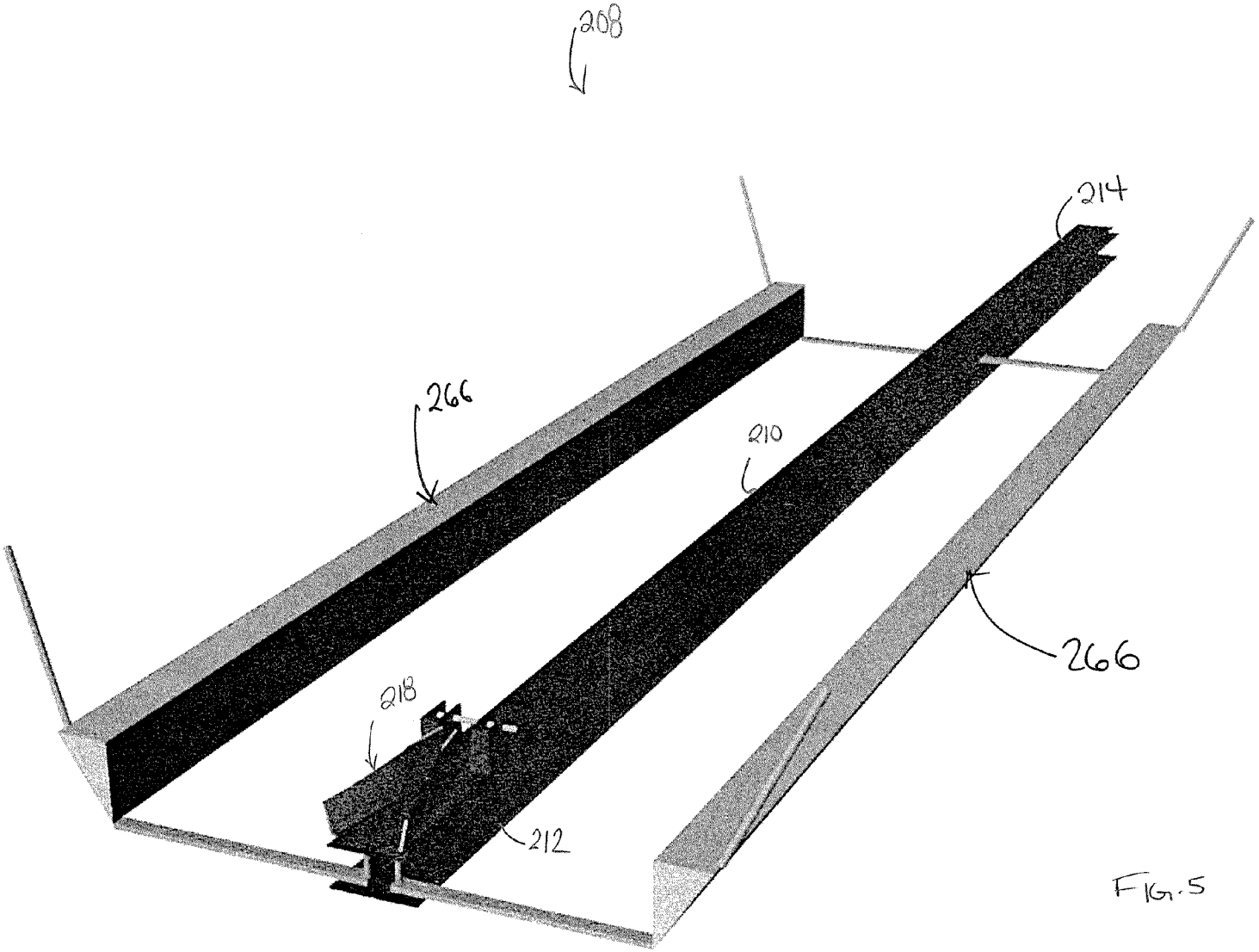
FIG. 5 is a partial perspective illustration of a rail, a sled, and supports of the retrieval assembly of FIG. 4.
Figure 12:
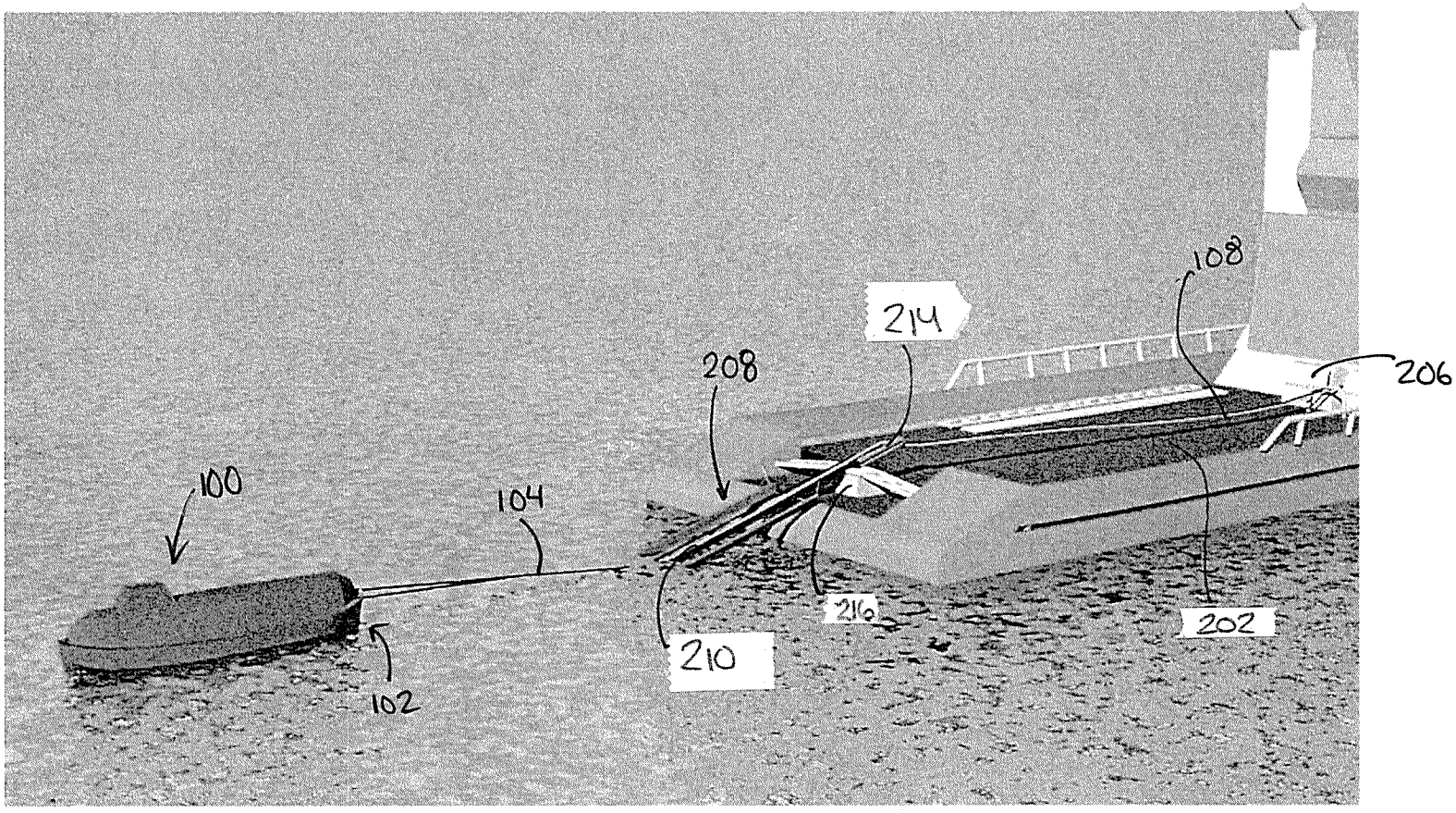
FIG. 12 is a perspective illustration of the life vessel and rescue vessel of FIG. 11, showing the retrieval assembly in the in-use configuration.

Referring to FIG. 5, the retrieval assembly 208 comprises a rail 210, which has a first end portion 212 and an opposed second end portion 214. When the retrieval assembly 208 is in the in-use configuration, the rail 210 is mounted to and pivotable about a fulcrum 216 (shown in FIG. 12), which is assembled to the deck 202 of the rescue vessel 200 proximate the stern of the rescue vessel 200. When the retrieval assembly 208 is in the in-use configuration, the rail 210 is pivoted about the fulcrum 212 so that the first end portion 212 of the rail 210 is the water (as shown in FIGS. 4 and 12). The retrieval assembly 208 further comprises a sled 218 mounted to the rail 210. As will be described in further detail below, the sled 218 is securable to the life vessel 100, and is slidable along the rail 210 from the first end portion 212 of the rail 210 towards the second end portion 214 of the rail 210, to lift the life vessel 100 onto the rescue vessel 200 as the towing device 206 draws the life vessel 100 towards the rescue vessel 200. A sled-rope 220 (shown in FIGS. 14 to 17) is attached to the sled 218. The sled-rope 220 is also attached to a second towing device (not shown) secured to the deck 202 of the rescue vessel 200, such as a second winch, for towing the sled 218 from the first end portion 212 towards the second end portion 214 of the rail 210.

Figure 6:
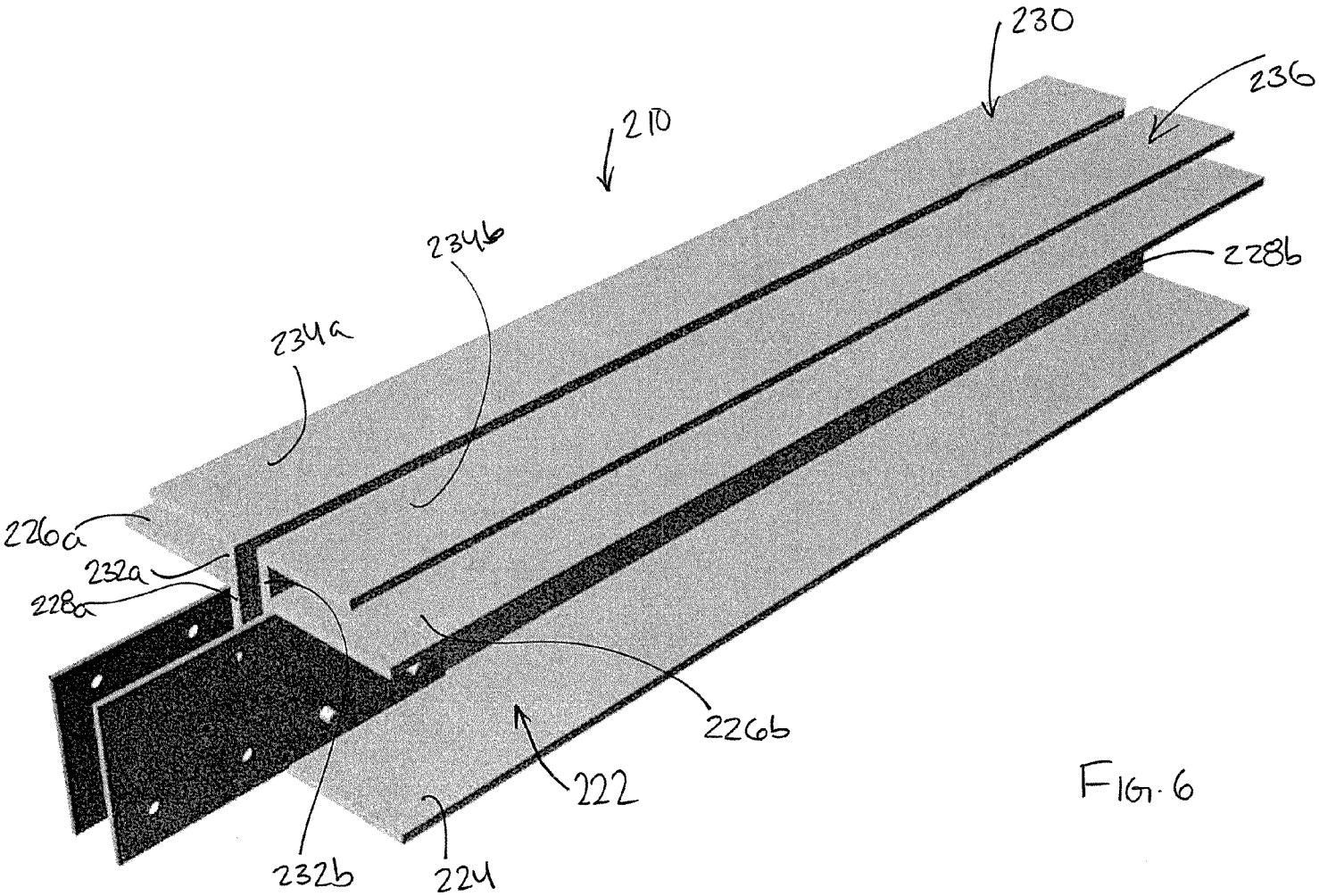
FIG. 6 is a perspective illustration of the rail of FIG. 5.

Referring to FIG. 6, the rail 210 is shown in further detail. The rail 210 comprises an H-beam 222 comprising a generally horizontal lower wall 224, a first 226*a* and a second 226*b* generally horizontal upper wall, and a first 228*a* and a second 228*b* generally vertical connecting wall extending between the lower wall 224 and the upper walls 226*a*, 226*b*, respectively. A T-beam 230 extends upwardly from the H-beam 222. The T-beam comprises a first 232*a* and a second 232*b* generally vertical spacing wall extending from the first 226 and second 226*b* upper walls, respectively, and a first 234*a* and a second 234*b* generally horizontal top wall extending from the spacing walls 232*a*, 232*b*. The first 234*a* and second 234*b* top walls form a sled support portion 236. The sled 218 is seatable on the sled support portion 236 of the rail 210, and is slideable therealong. The sled-support portion 236 may be coated with a low-friction material, such as a high-density polyethylene, to allow for sliding of the sled 218.

Figure 7:
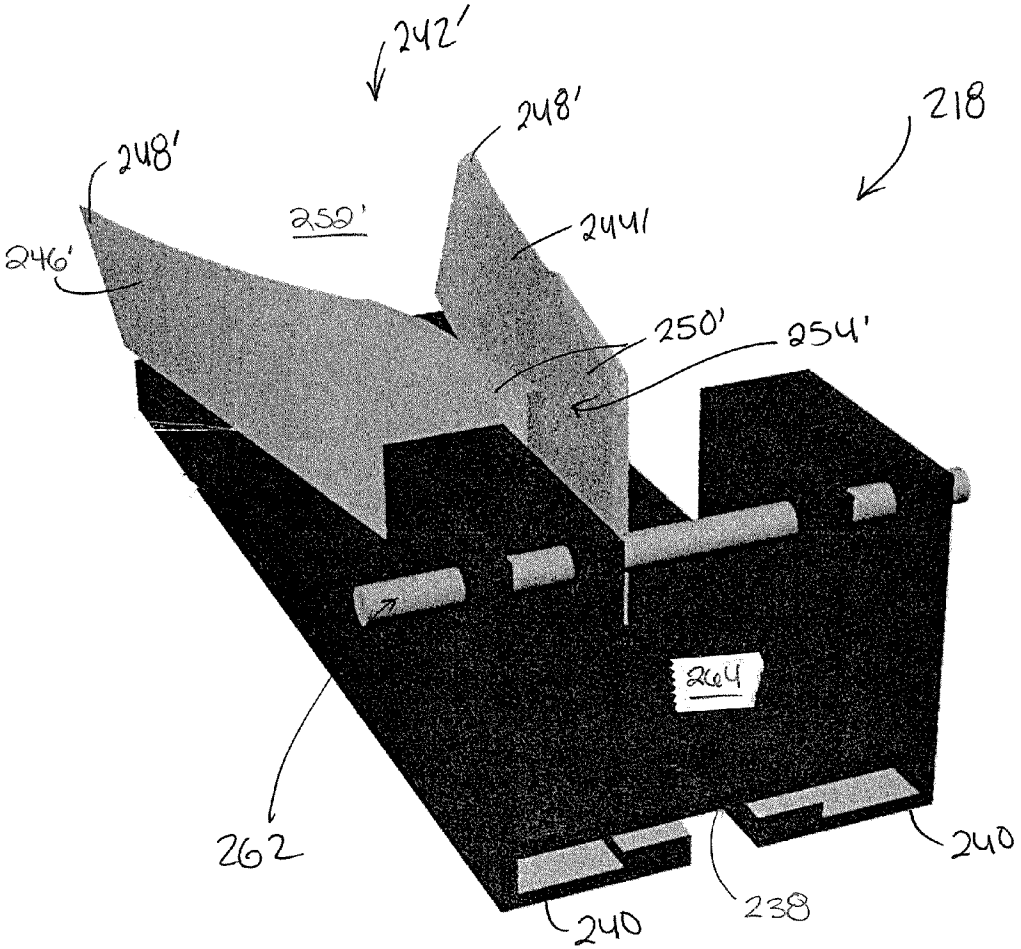
FIG. 7 is a perspective illustration of the sled of FIG. 5.

Referring to FIG. 7, the sled 218 is shown in further detail. The sled 218 comprises a base wall 238 that is seatable on the sled support wall, and a pair of stabilizer walls 240 extending downwardly and inwardly from the base wall 238. When the sled 218 is mounted to the rail 210, the stabilizer walls 240 are positioned between the top walls 234*a*, 234*b*, and the upper walls 226*a*, 226*b*.

The sled further comprises a sled locking assembly 242'. As will described in further detail below, the life vessel locking assembly 110' of FIG. 14 is lockable to the sled locking assembly 242', to secure the life vessel 100 to the sled 218. The sled locking assembly 242' comprises a pair of jaws 244', 246' which are mounted to the base wall 238. Each jaw 244', 246' has a first end 248' positioned towards the first end portion 212 of the rail 210, and a second end 250' positioned away from the first end portion 212 of the rail 210. The first ends 248' of the jaws define a first opening 252' facing towards the first end portion 212 of the rail 210, and the second ends 250' of the jaws 244', 246' define a second opening 254' facing towards the second end portion 214 of the rail 210. The second ends 250' of the jaws 244, 246 are movable towards and away from each other, and are biased towards each other. The manner of locking the sled locking assembly 242' to the life vessel locking assembly 110' will be described further below.

Figure 8:
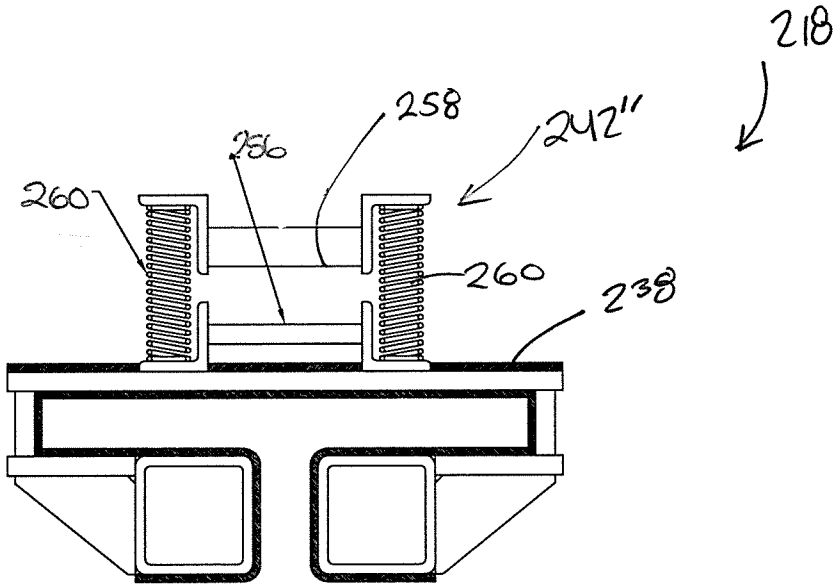
FIG. 8 is a simplified front view of an alternate sled.

Referring to FIG. 8, another exemplary sled locking assembly 242" is shown. The sled locking assembly 242" is configured to lock to the life vessel locking assembly 110" of FIG. 18, described above. The sled locking assembly 242" is similar to the sled locking assembly 242" of FIG. 8 (although the jaws are not shown in FIG. 8), however the sled locking assembly 242" further comprises a rib 256 extending generally transverse to the jaws and positioned outboard of the second ends of the jaws in a direction towards the second end portion 214 of the rail 210. The sled locking assembly 242" further comprises a bearing surface 258 positioned above the rib 256. The bearing surface 258 is moveable towards and away from the rib 256, and is biased towards the rib 256 by springs 260. The manner of locking the sled locking assembly 242" to the life vessel locking assembly 110" will be described further below.

Referring back to FIG. 7, the sled 218 further comprises a tow-line guide 262. The tow-line guide 262 defines an eye 264 through which the tow-line 104 may be threaded, as will be described in further detail below.

Referring back to FIG. 5, the retrieval assembly further comprises a pair of life vessel supports 266 mountable to the rail 210 on opposed sides of the rail 210. As will be described in further detail below, the life vessel 100 is receivable between the supports 266 and supported thereby when the life vessel 100 is locked to the sled 218.

Figure 9:
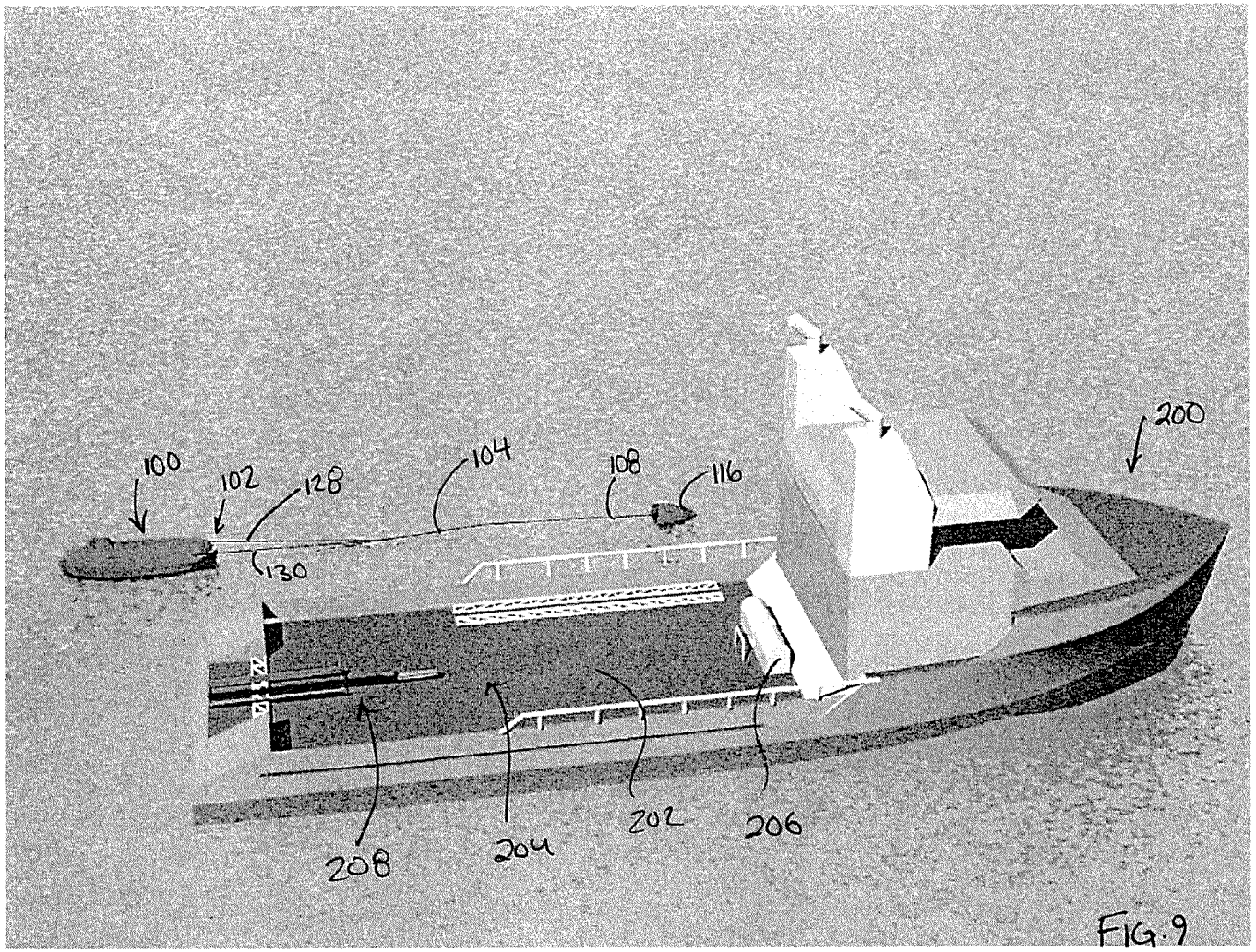
FIG. 9 is a perspective illustration of the life vessel and rescue vessel of FIG. 1, showing the tow-line in the deployed position.

Referring now to FIGS. 1 and 9 to 27, the interaction of the life vessel system 102 and rescue vessel system 204 will presently be described. As mentioned hereinabove the life vessel 100 may, for example, have been deployed from a sinking or damaged vessel, and may have one or more passengers aboard. Referring to FIG. 1, the rescue vessel 200 may first approach the life vessel 100. Referring to FIG. 9, the tow-line 104 may then be deployed from the life vessel 100 into the water. In order to deploy the tow-line 104, a user on the rescue vessel 200 may activate the activation control, which will wirelessly communicate with the receiver of the life vessel system 102, to deploy the tow-line 104. For example, as mentioned hereinabove, when the receiver receives a signal, the receiver may send a signal to the actuator, and the actuator may cause the housing 114 to open. When the housing 114 is open, the second end portion 108 of the tow-line 104 may drop into the water. Alternately, as mentioned hereinabove, rather the dropping the second end portion 108 of the tow-line 104 into the water, a launching system may be provided, which may launch the second end portion 108 of the tow-line 104 away from the life vessel 100 and into the water. After the tow-line 104 is deployed into the water, the drogue 116 may cause the life vessel 100 to orient head-to-sea.

Figure 10:
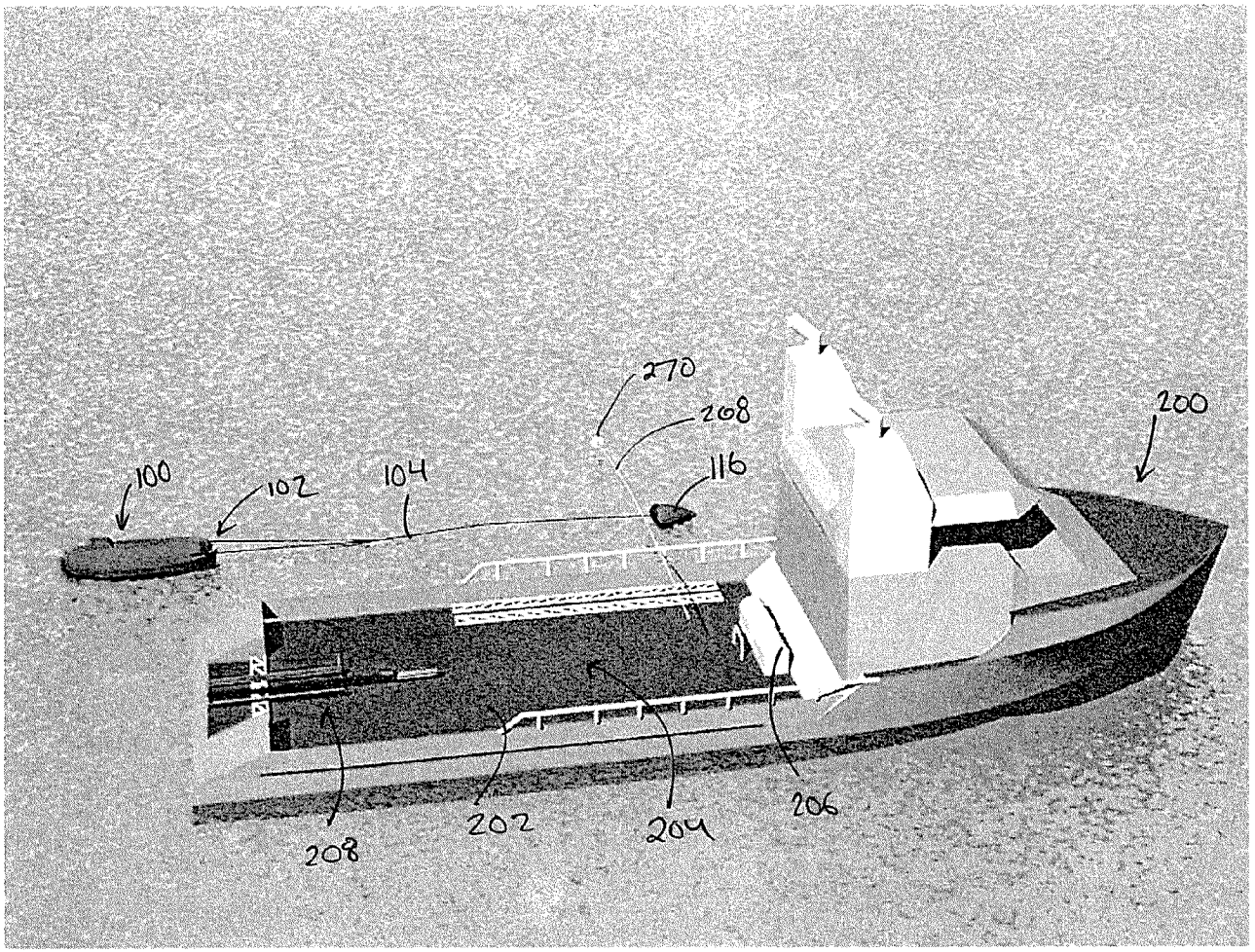
FIG. 10 is a perspective illustration of the life vessel and rescue vessel of FIG. 9, showing the tow line being retrieved from the water.

Referring to FIG. 10, the tow-line 104 may then be retrieved from the water. For example, the rescue vessel system 204 may comprise a pneumatic line throwing gun (not shown), and a line 268 and grapnel 270. The pneumatic line throwing gun may be activated to launch the line 268 and grapnel 270 from the rescue vessel 200 over the tow-line 104. The grapnel 270 may then be pulled back towards the rescue vessel 200 while hooking the grapnel 270 to the tow-line 104.

Figure 11:
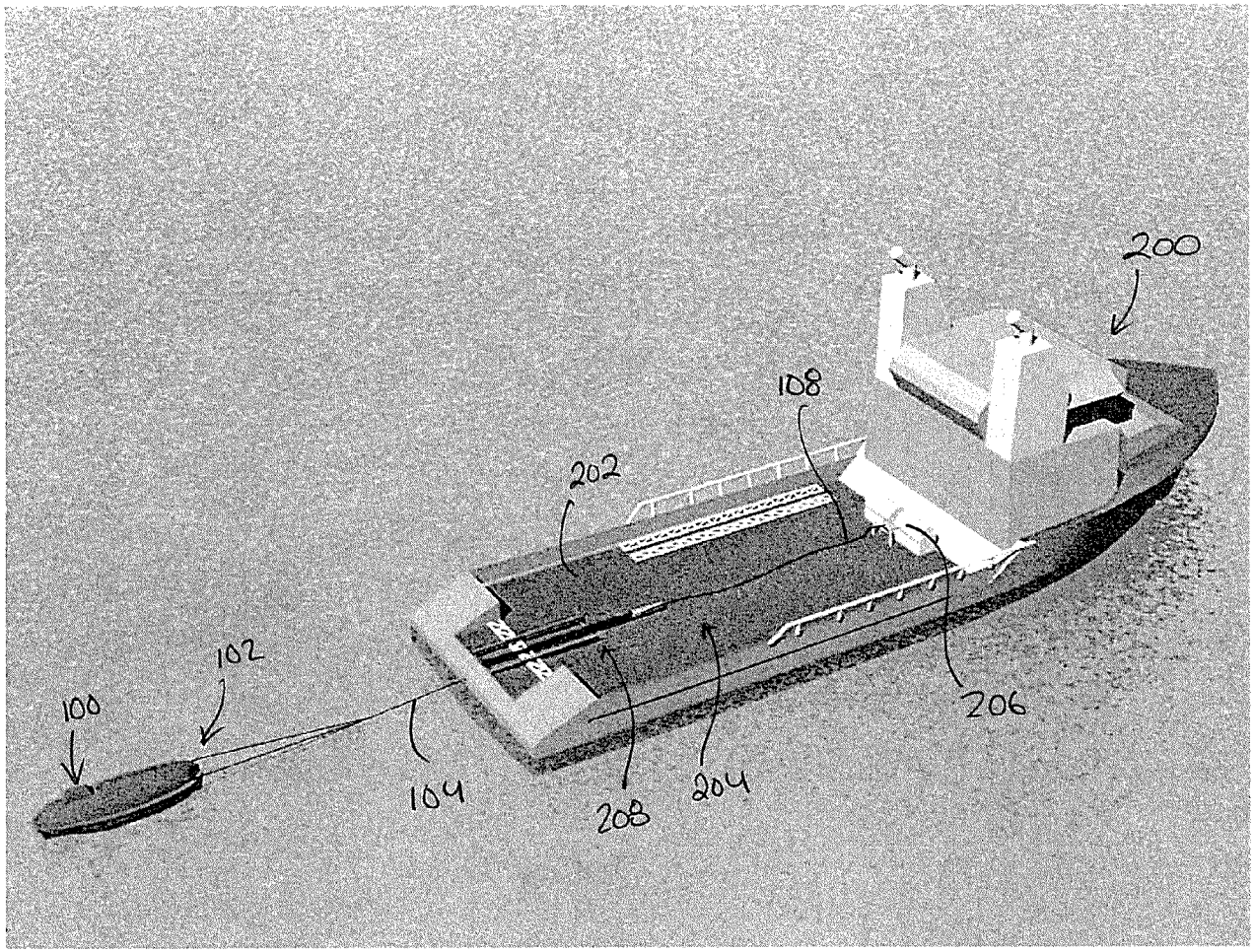
FIG. 11 is a perspective illustration of the life vessel and rescue vessel of FIG. 10, showing the tow line secured to a towing device and threaded through the sled.

Referring to FIG. 11, the second end 108 of the tow-line 104 may then be secured to the towing device 206 of the rescue vessel 200. Particularly, the drogue 116 and sea anchor may be removed from the second end 108 of the tow-line 104. The tow-line 104 may then be fed through the eye 264 of the sled 118, and secured to the towing device 206.

Referring to FIG. 12, the retrieval assembly 208 may then be reconfigured into the in-use configuration. Particularly, the fulcrum 216 may be assembled to the deck 202 of the rescue vessel 200 proximate the stern of the rescue vessel 200, if not already done. The rail 210 may then be mounted to the fulcrum 216, and pivoted about the fulcrum 216 such that the first end portion 212 of the rail 210 is in the water, and the second end portion 214 is above the deck. If not already done, the sled 218 may be mounted to the rail 210 and positioned at the first end portion 212 of the rail 210, in the water. In some examples, the sled 218 may further include a brake (not shown). When the rescue vessel system 204 is assembled, the brake may be engaged to lock the sled 218 at the first end portion 212 of the rail 210.

Figure 13:
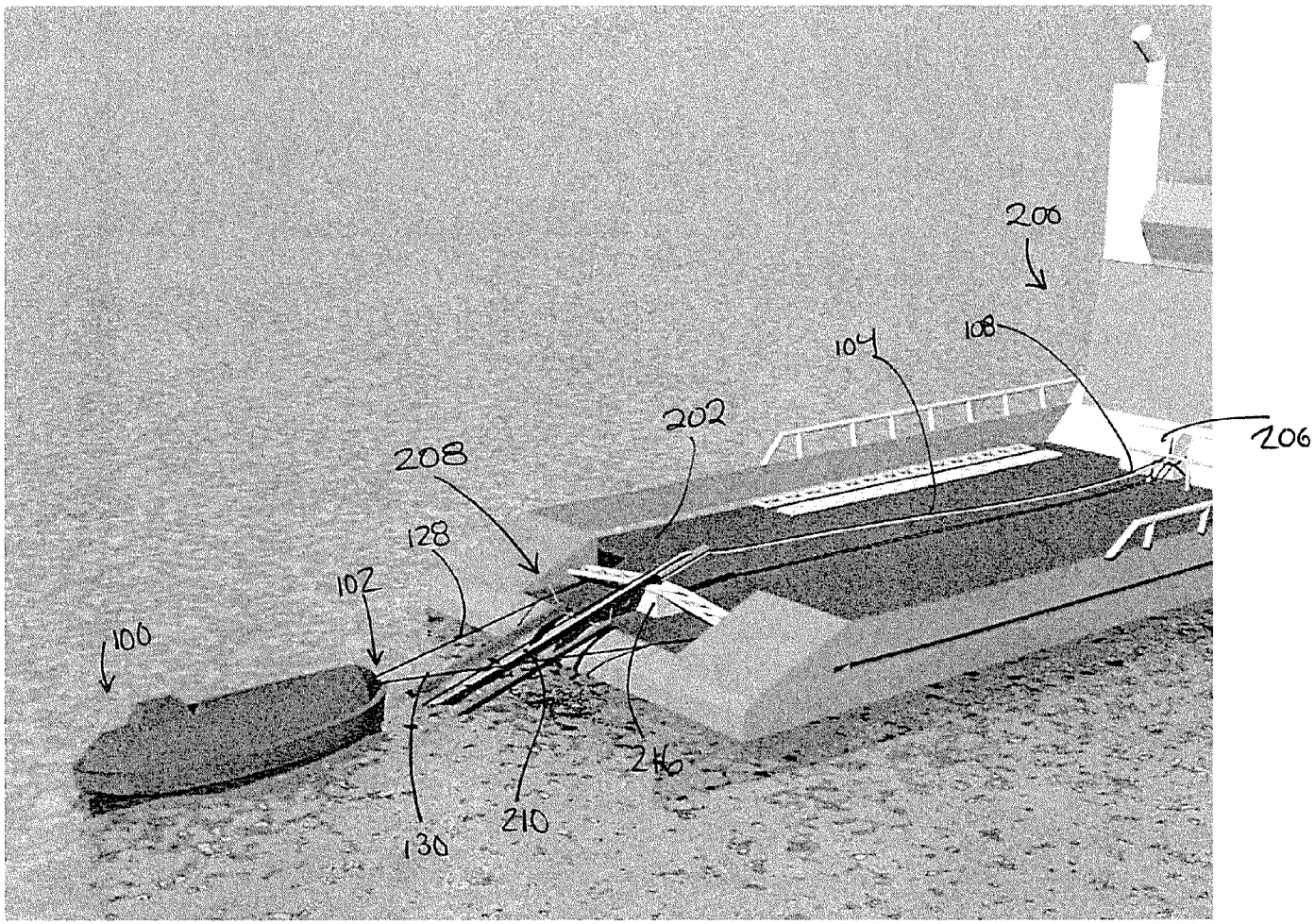
FIG. 13 is a perspective illustration of the life vessel and rescue vessel of FIG. 11, showing the life vessel approaching the sled.

Referring to FIG. 13, the towing device 206 may then be activated to tow the life vessel 100 towards the rescue vessel 200. As the life vessel 100 approaches the rescue vessel 200, the control lines 128, 130 may be manually released from the tow-line 104 and may be secured to the rescue vessel 200.

Referring to FIG. 14, as the first end portion 106 of the tow-line 104 is secured to the life vessel locking assembly 110, and as the tow-line 104 is fed through the eye 264 of the sled 218, the life vessel locking assembly 110 will be towed towards the first end portion 212 of the rail 210, and will approach the sled 218.

Figure 15:
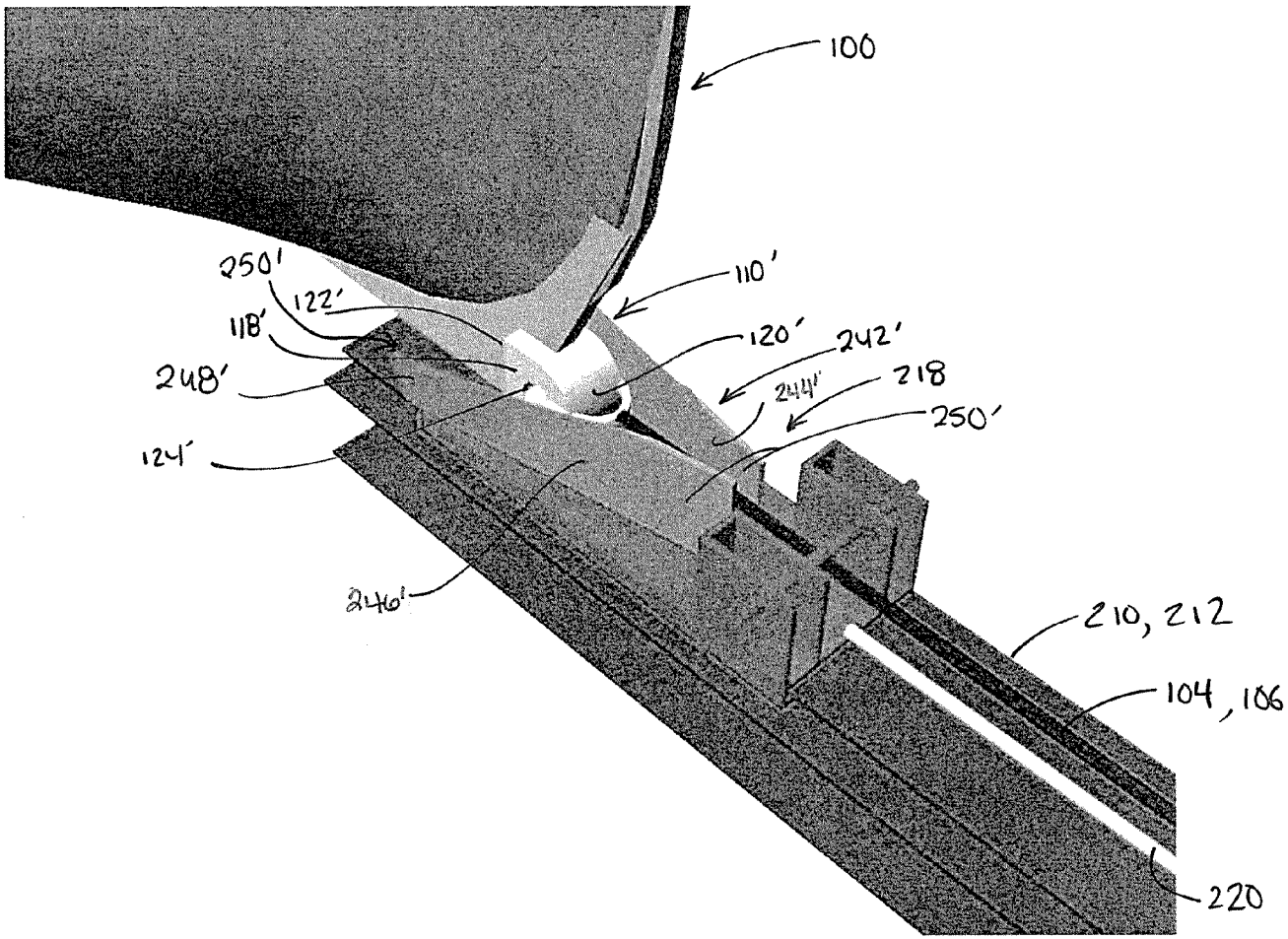
FIG. 15 is an enlarged perspective illustration showing a shoe of the life vessel locking assembly of FIG. 14 entering the jaws of the sled locking assembly of FIG. 14.
Figure 16:
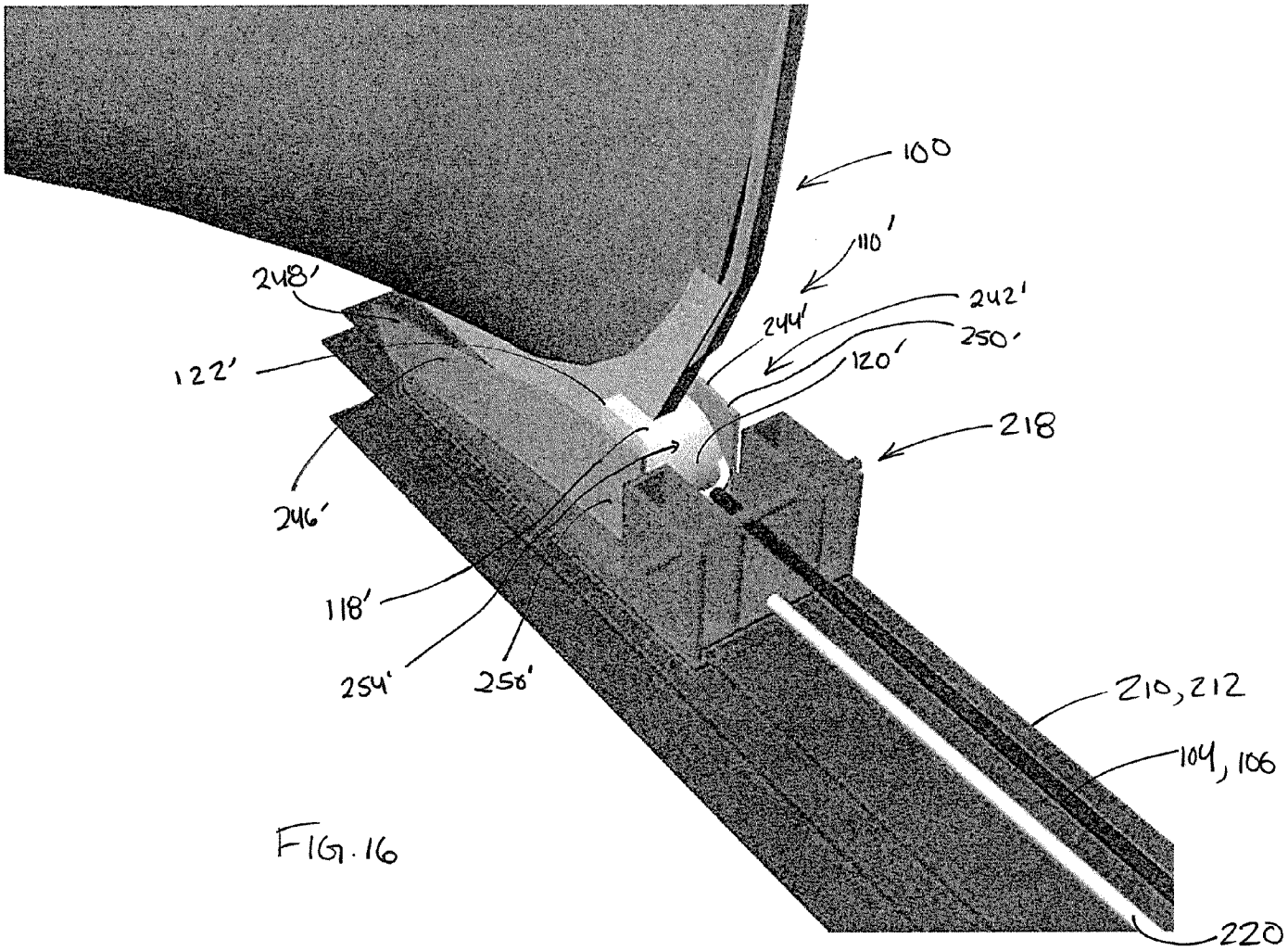
FIG. 16 is an enlarged perspective illustration showing the shoe of the life vessel locking assembly of FIG. 15 exiting the jaws of the sled locking assembly of FIG. 15.
Figure 17:
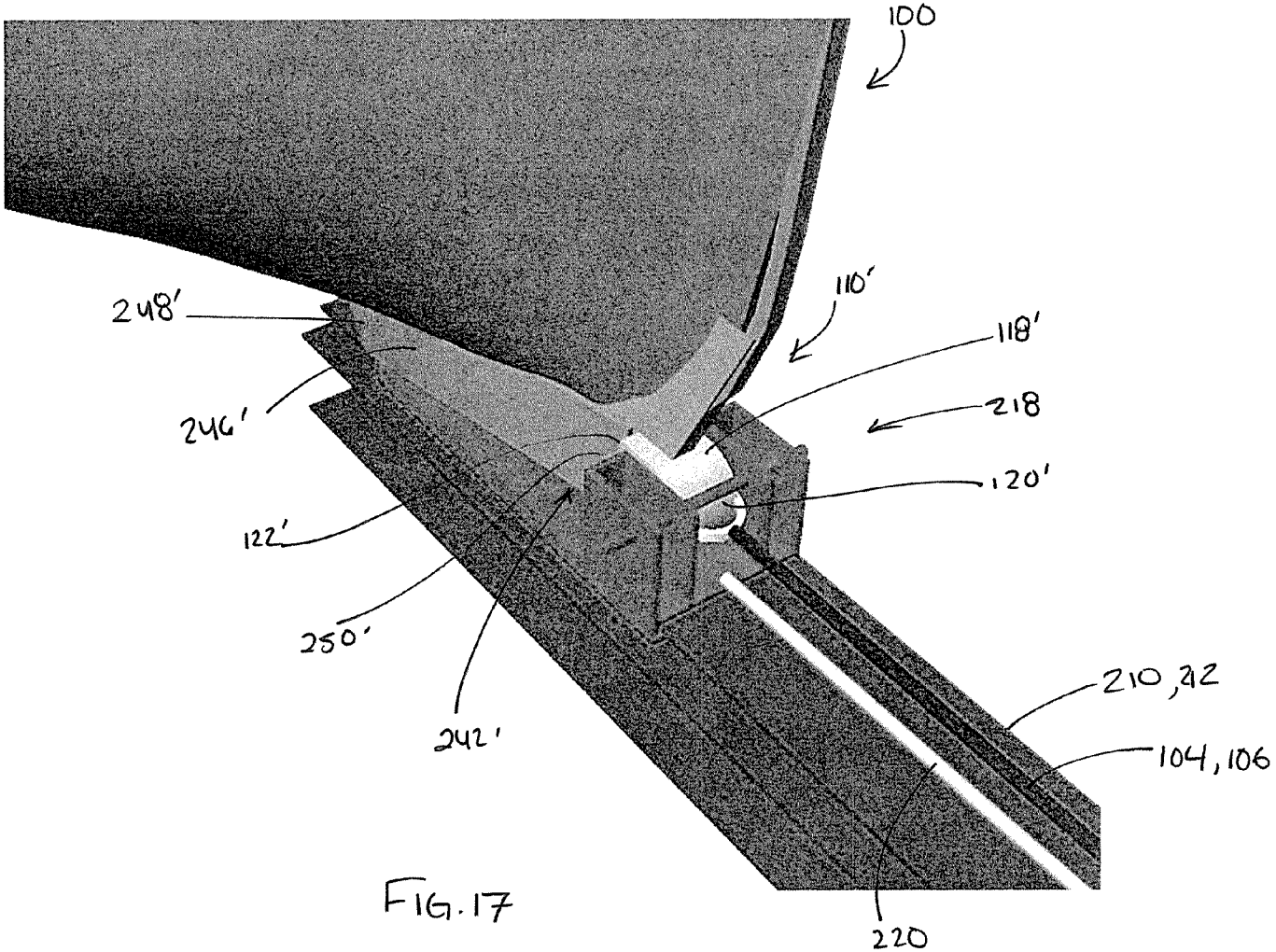
FIG. 17 is an enlarged perspective illustration showing the life vessel locking assembly locked to the sled locking assembly.

Referring to FIGS. 15 to 17, the life vessel 100 may then be towed onto the sled 218 and locked the sled 218. Particularly, as the towing device 206 tows the tow-line 104, the shoe 118 will enter the first opening 250' of the jaws 244', 246', as shown in FIG. 15. The shoe 118 will travel towards the second opening 254', and will force the second ends 250' of the jaws 244', 246' away from each other, as shown in FIG. 16. The shoe 118' will then exit the second opening 254', and the second ends 250' of the jaws 244', 246', will then move back towards each other behind the shoulder at the rearward surface 222' of the shoe 118', as shown in FIG. 17. When the jaws 244', 246' are in place behind the shoulder, the life vessel 100 is secured to the sled 218.

Figure 19:
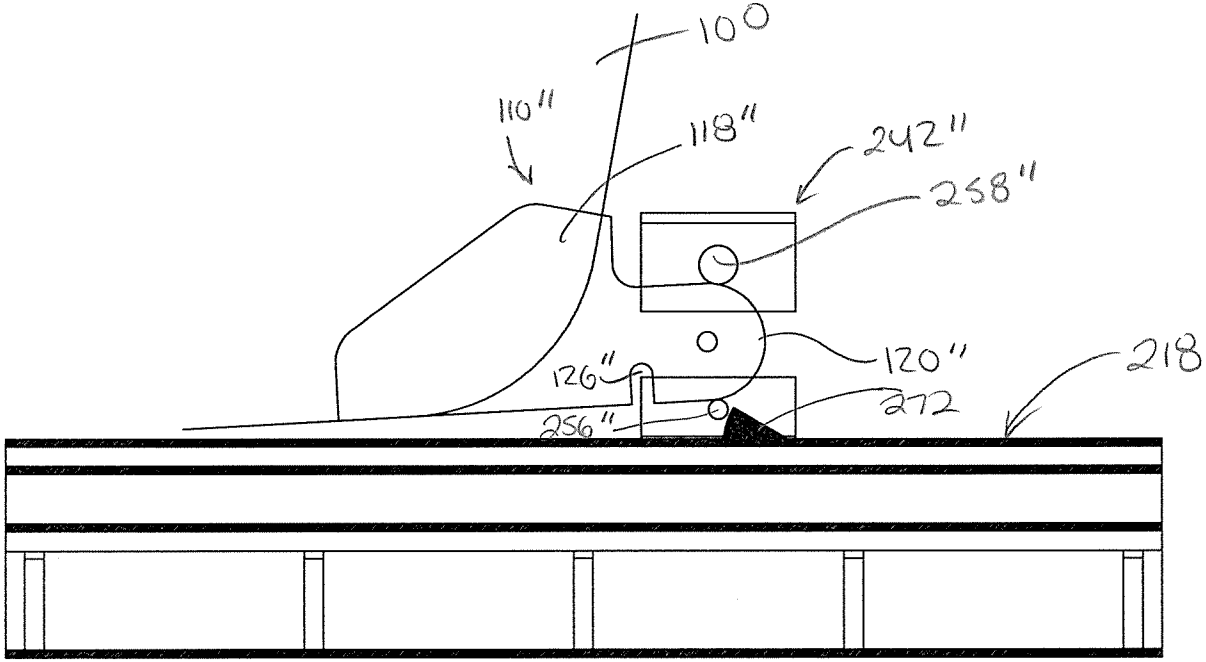
FIG. 19 is a simplified plan view of the alternate life vessel locking assembly and alternate sled locking assembly of FIG. 18, showing a shoe beginning to engage a rib.
Figure 20:
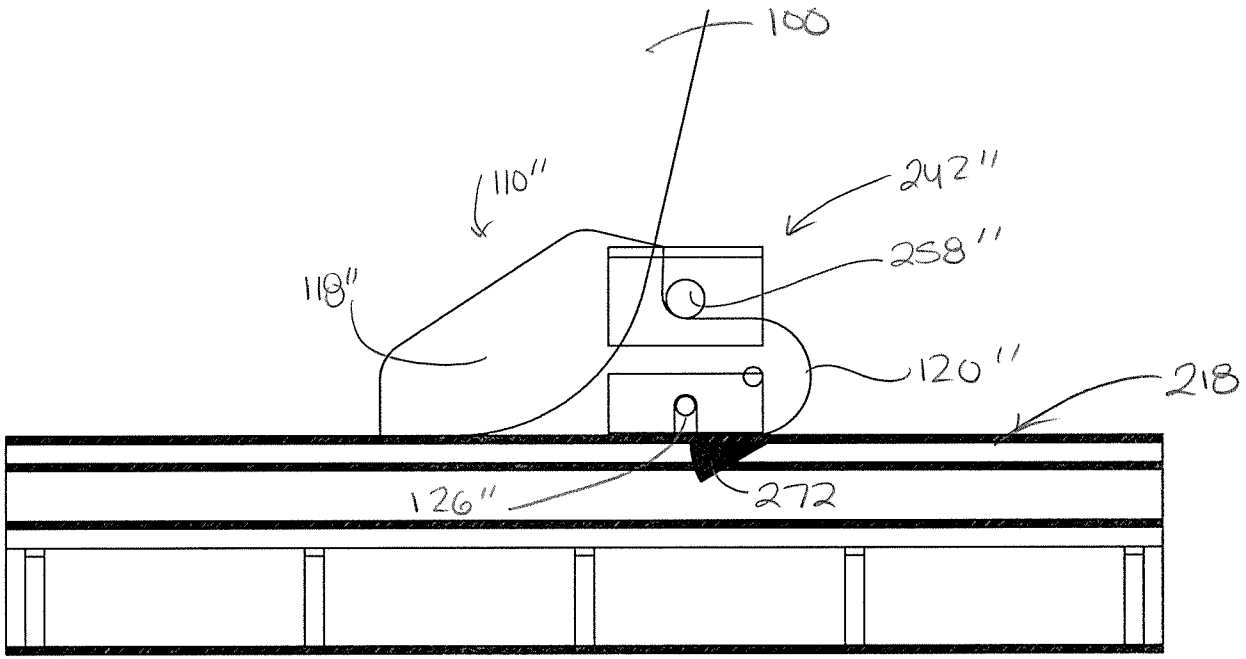
FIG. 20 is a simplified plan view of the alternate life vessel locking assembly and alternate sled locking assembly of FIG. 19, showing the alternate life vessel locking assembly locked to the alternate sled locking assembly.

In the alternate example of the life vessel locking assembly 110" and sled locking assembly 242" (described hereinabove with reference to FIGS. 8 and 18), the jaws and shoe may interact as described with respect to FIGS. 15 to 17. However, in addition, referring to FIGS. 18 to 20, as the towing device 206 tows the tow-line 104 (not shown in FIGS. 18 to 20), the shoe 118" will approach the rib 256" and bearing surface 258", as shown in FIG. 18. Referring to FIG. 19, the curved forward surface 120" of the shoe 118" will then hit the rib 256", and cause the shoe 118" to lift over the rib 118". The lifting of the shoe 118" will cause the bearing surface 258" to raise away from the rib 256". Referring to FIG. 20, as the towing device 206 continues to tow the tow-line 104, the rib 256" will snap into the groove 126", and the bearing surface 258" will bear against the shoe 118", to further secure the life vessel 100 to the sled 118.

As can be seen in FIGS. 18 to 20, in the example shown, a sled brake release 272 may be mounted adjacent the rib 256". When the rib 256" snaps into the groove 126", the shoe 118" may activate the sled brake release 272, to disengage the sled-brake.

Figure 21:
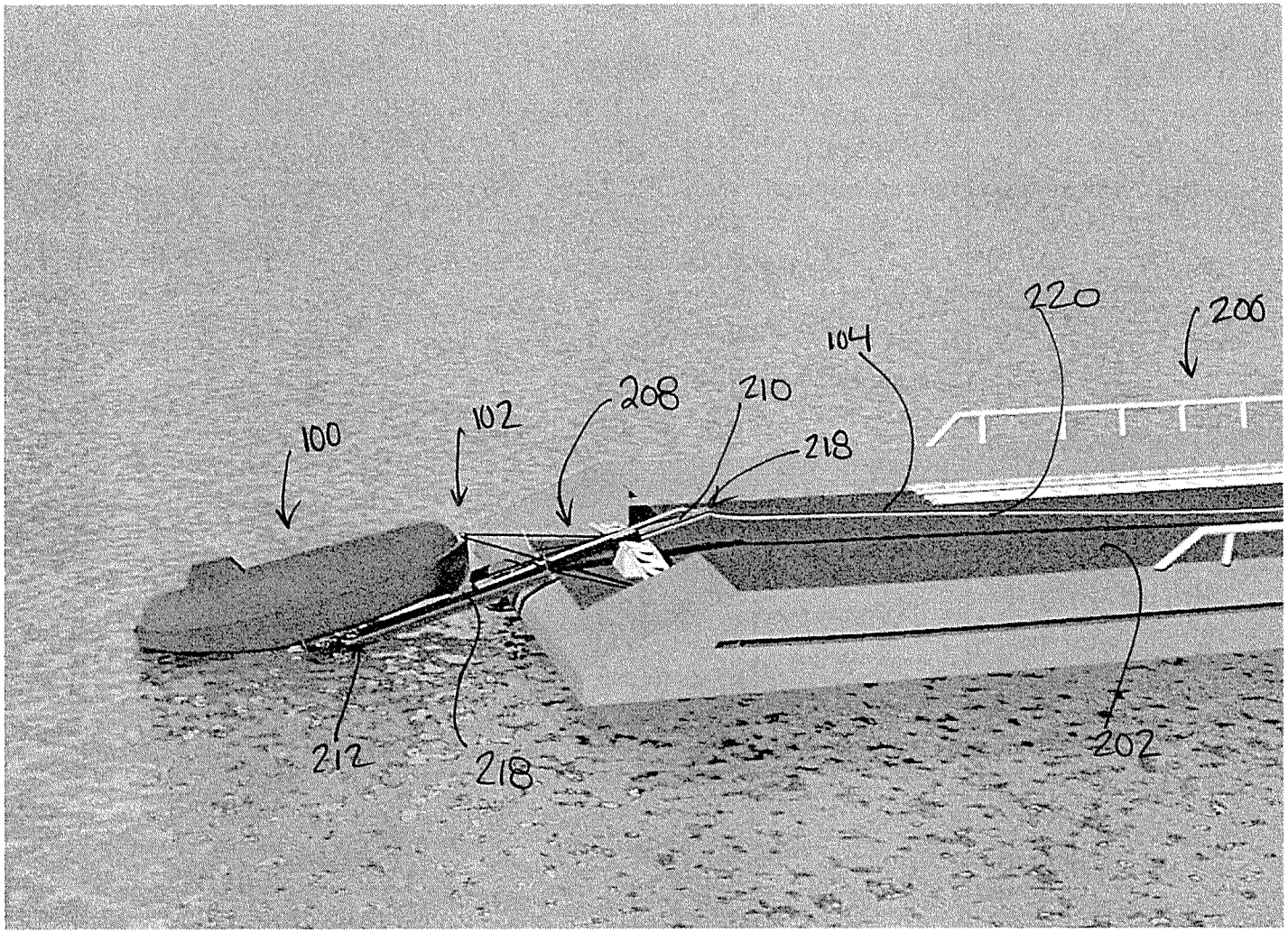
FIG. 21 is a perspective illustration of the life vessel and rescue vessel of FIG. 13, showing the life vessel and sled being towed up the rail of the retrieval assembly.
Figure 22:
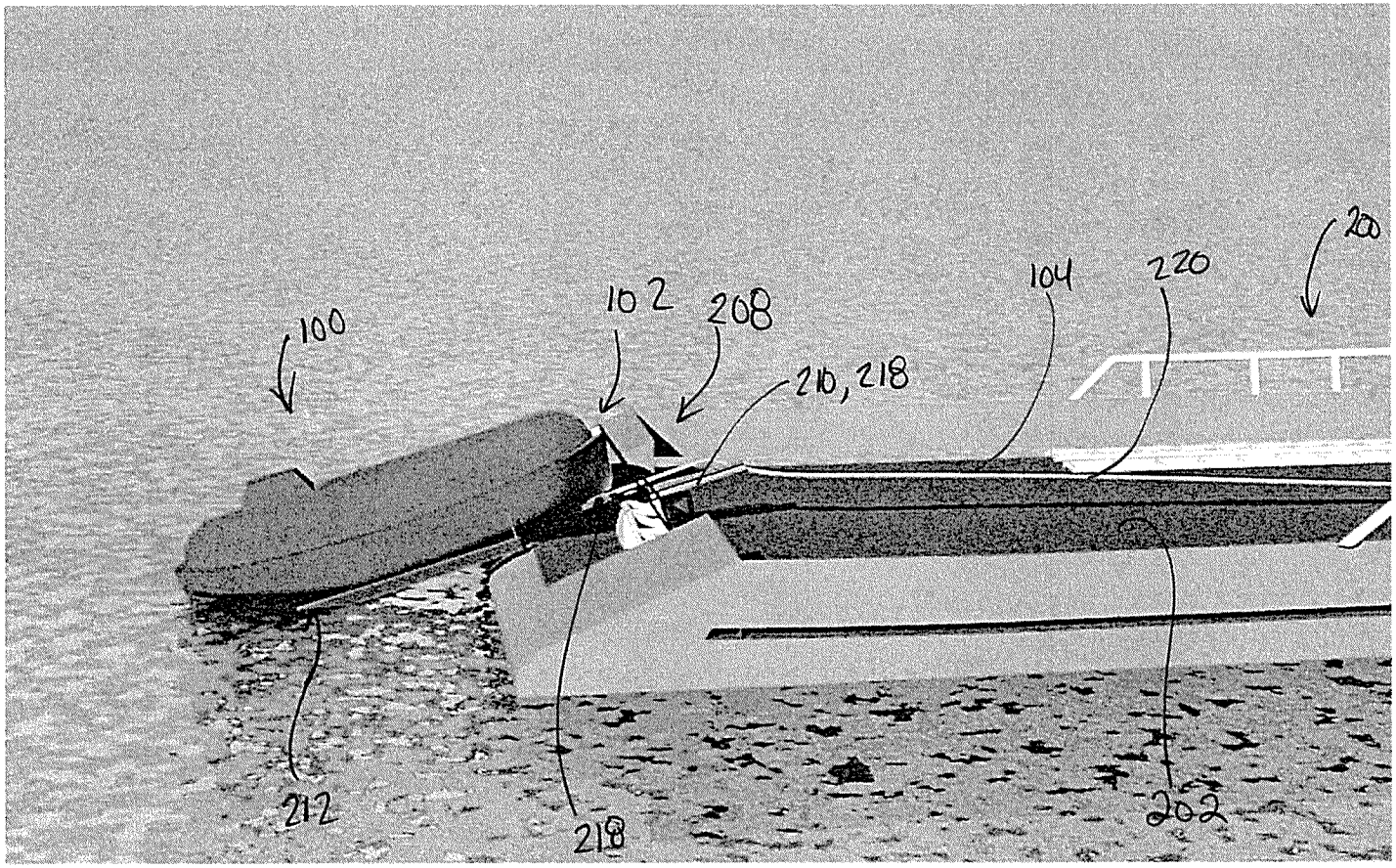
FIG. 22 is a perspective illustration of the life vessel and rescue vessel of FIG. 21, showing the life vessel and sled being towed further up the rail of the retrieval assembly.

Referring to FIGS. 21 to 22, the life vessel 100 and sled 218 may then be towed from the first end portion 212 of the rail 210 towards the second end portion 214 of the rail 210. Particularly, the towing device 206 may continue to tow the tow-line 104, and the second winch may be activated to draw in the sled-rope 220 and tow the sled 218 along the rail 210 towards the second end portion 214 of the rail 210.

Figure 23:
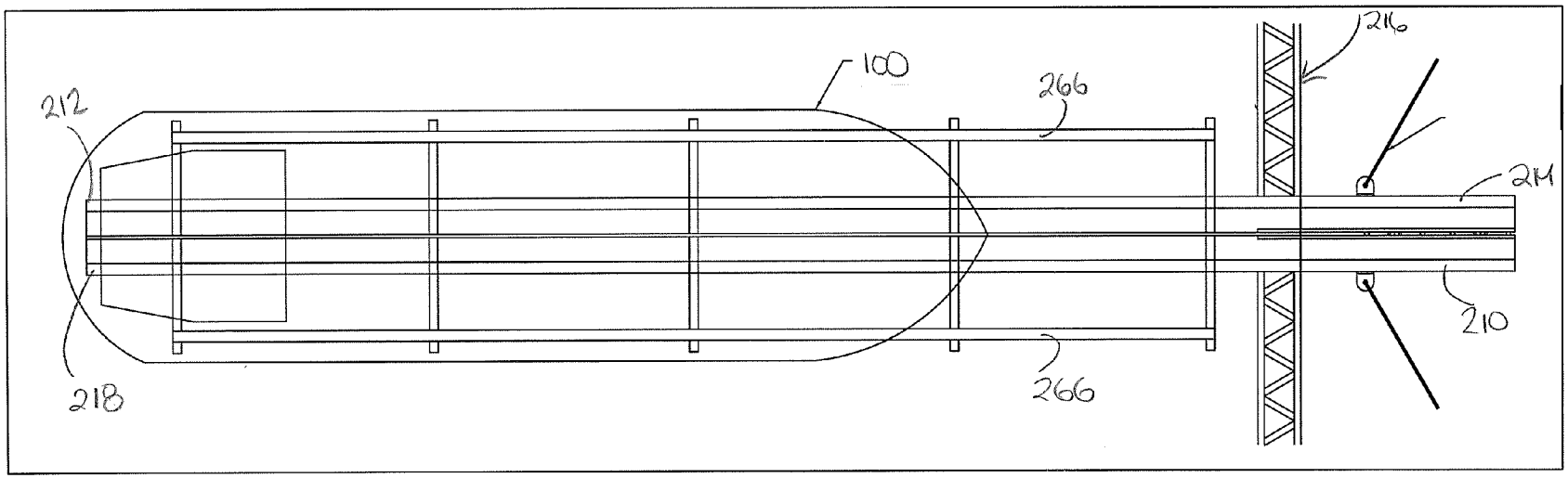
FIG. 23 is a simplified top plan view of the life vessel and rescue vessel in the position of FIG. 21, showing supports of the retrieval assembly supporting the rescue vessel.
Figure 24:
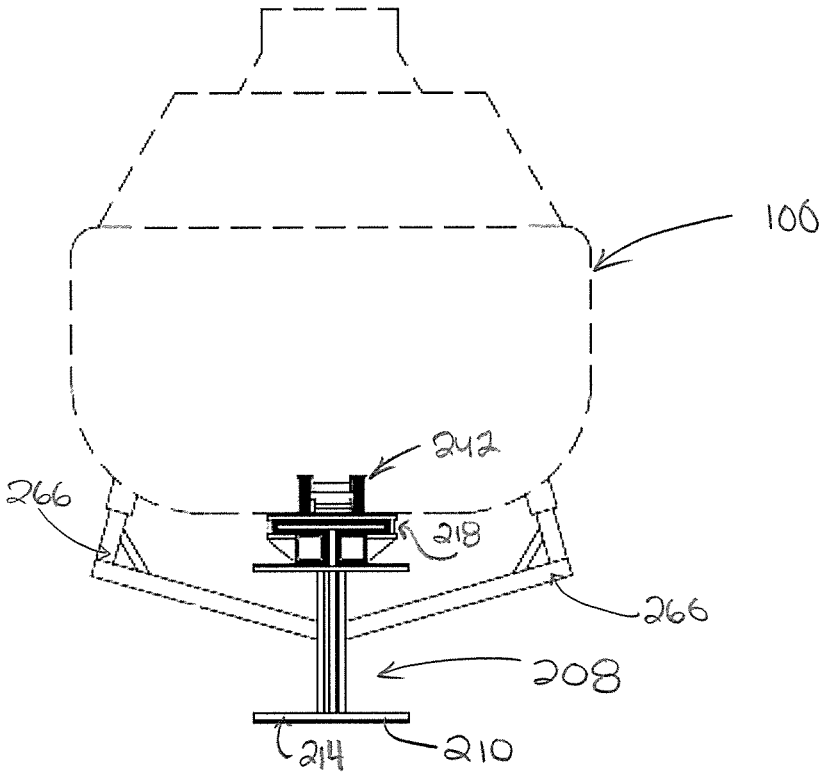
FIG. 24 is a simplified front plan view of the life vessel and rescue vessel in the position of FIG. 21, showing supports of the retrieval assembly supporting the rescue vessel.

Referring to FIGS. 23 and 24, as the life vessel 100 and sled 218 travel towards the second end portion 214 of the rail 210, the life vessel 100 will be stabilized by the life vessel supports 266.

Figure 25:
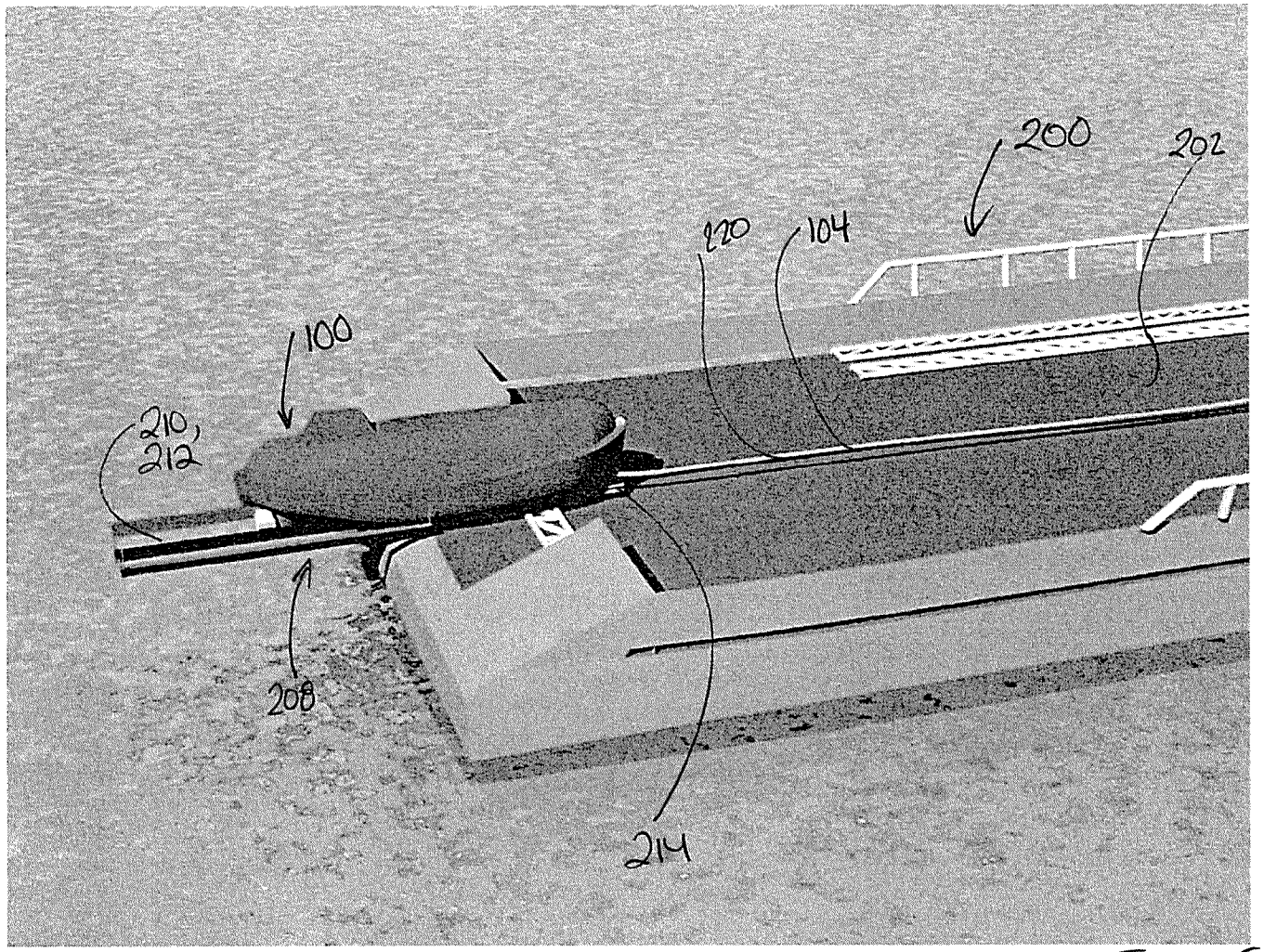
FIG. 25 is a perspective illustration of the life vessel and rescue vessel of FIG. 22, showing the life vessel and sled being towed yet further up the rail of the retrieval assembly, and showing the rail pivoted to a generally horizontal position.

Referring to FIG. 25, as the sled 218 approaches the second end 214 of the rail 210, the fulcrum 216 may be lowered, so that the first end portion 212 of the rail 210 is out of the water, the second end 214 of the rail 210 is adjacent the deck 202, and the rail 210 is generally horizontal. The lowering of the fulcrum 216 may be done manually, or an automated system may be in place to lower the fulcrum 216. The sled 218 and life vessel 100 may then continue to be towed towards the second end 214 of the rail 210. Alternately, depending on the positioning of the fulcrum 216 with respect to the rail 210, rather than lowering the fulcrum 216, the rail may be passively allowed to pivot over the fulcrum due to the weight of the life vessel 100, so that the first end portion 212 of the rail 210 is out of the water, and the second end portion 214 of the rail 210 is adjacent the deck 202 of the rescue vessel 200.

Referring still to FIG. 25, when the life vessel 100 is horizontal and on the deck 202 of the rescue vessel 200 any passengers may then be unloaded from the life vessel 100.

Referring to FIGS. 26 and 27, the life vessel 100 may then be disassembled from the sled 210, as shown in FIG. 26, and stowed on the deck 202 of the rescue vessel 200, as shown in FIG. 27.

Referring to FIGS. 28 to 30, in an alternate example, after the sled 218 and life vessel 100 are towed towards the second end 214 of the rail 210 (as shown in FIG. 28), the rail 210 may be pulled onto the deck 202 of the rescue vessel 200 together with the life vessel 100 (as shown in FIGS. 29 and 30). For example, the rail 210 may be slidable on a track (not shown) of the deck 202.

Various apparatuses or methods have been described above to provide an example of each claimed invention. No example described above limits any claimed invention and any claimed invention may cover processes or apparatuses that are not described above. The claimed inventions are not limited to apparatuses or processes having all of the features of any one apparatus or process described above or to features common to multiple or all of the apparatuses described above. It is possible that an apparatus or process described above is not an embodiment of any claimed invention. Applicant reserves the right to claim such apparatuses or processes in other applications.

The invention claimed is:

1. A system for retrieving a life vessel from water and drawing the life vessel onto a deck of a rescue vessel, the system comprising:

a) a life vessel system comprising:

i) a tow-line comprising a first end portion secured to the life vessel and an opposed second end portion; and ii) a deployment system configured to deploy the second end portion of the tow-line into the water; and b) a rescue vessel system comprising:

i) a towing device on the rescue vessel, the towing device configured to receive the second end portion of the tow-line and retract the tow-line to draw the life vessel towards the rescue vessel; and ii) a retrieval assembly assembled to the deck of the rescue vessel, the retrieval assembly configured to receive the life vessel as the life vessel is drawn towards the rescue vessel and to lift the rescue vessel onto the deck; and c) a first and a second control line, each control line mounted between the life vessel and the tow-line, wherein the first end portion of the tow-line is secured to a forefoot of a keel of the life vessel, comprising a drogue mounted to the second end portion of the tow-line.

2. The system of claim 1, wherein the rescue vessel system further comprises a grapnel for retrieving the tow-line from the water.

3. The system of claim 1, wherein the towing device comprises a winch.

4. A system for retrieving a life vessel from water and drawing the life vessel onto a deck of a rescue vessel, the system comprising:

a) a life vessel system comprising:

i) a tow-line comprising a first end portion secured to the life vessel and an opposed second end portion; and ii) a deployment system configured to deploy the second end portion of the tow-line into the water; and b) a rescue vessel system comprising:

i) a towing device on the rescue vessel, the towing device configured to receive the second end portion of the tow-line and retract the tow-line to draw the life vessel towards the rescue vessel; and c) a retrieval assembly assembled to the deck of the rescue vessel, the retrieval assembly configured to receive the life vessel as the life vessel is drawn towards the rescue vessel and to lift the rescue vessel onto the deck, the retrieval assembly comprising:

i) a fulcrum assembled to the deck of the rescue vessel proximate a stern of the rescue vessel;

ii) a rail comprising a first end portion and a second end portion, the rail mounted to the fulcrum and pivotable thereabout to lower the first end of the rail off of the stern into the water;

iii) a sled mounted to the rail, the sled securable to the life vessel and slideable along the rail from the first end portion of the rail towards the second end portion to lift the life vessel onto the rescue vessel as the towing device draws the life vessel towards the rescue vessel.

5. The system of claim 4, wherein:

a) the life vessel system further comprises a life vessel locking assembly secured to the life vessel;

b) the sled comprises a sled locking assembly; and c) the life vessel locking assembly is lockable to the sled locking assembly to secure the life vessel to the sled.

6. The system of claim 5, wherein the life vessel locking assembly is mounted to a forefoot of a keel of the life vessel.

7. The system of claim 6, wherein the first end portion of the tow-line is secured to the life vessel locking assembly, wherein the life vessel locking assembly is configured to automatically lock to the sled locking assembly as the towing device draws the life vessel towards the rescue vessel.

8. The system of claim 5, wherein:

a) the sled locking assembly comprises a pair of jaws mounted to the sled, b) each jaw has a first end positioned towards the first end portion of the rail, and a second end positioned away from the second end portion of the rail;

c) the first ends of the jaws define a first opening facing towards the first end portion of the rail, and the second ends of the jaws define a second opening facing towards the second end portion of the rail; and d) the second ends of the jaws are movable towards and away from each other and are biased towards each other.

9. The system of claim 8, wherein:

a) the life vessel locking assembly comprises a shoe extending outwardly from the forefoot of the keel of the life vessel; and b) the shoe comprises a forward surface and a rearward surface defining a shoulder.

10. The system of claim 9, wherein the shoe is configured to enter the first opening as the towing device draws the life vessel towards the rescue vessel, travel towards the second opening and move the second ends of the jaws away from each other, and exit the second opening such that the second ends of the jaws move back towards each other behind the shoulder and abut the shoulder to secure the life vessel to the sled.

11. The system of claim 9, wherein the sled locking assembly further comprises:

a) a rib extending generally transverse to the jaws and positioned outboard of the second ends of the jaws in a direction towards the second end portion of the rail, and b) a bearing surface positioned above the rib, the bearing surface moveable towards and away from the rib and biased towards the rib.

12. The system of claim 11, wherein the shoe further comprises a groove extending upwardly into the shoe from a lower surface thereof and extending laterally across the shoe.

13. The system of claim 12, wherein the rib is receivable in the groove and the bearing surface is bearable against the shoe to maintain the rib in the groove and to further secure the life vessel to the sled.

14. The system of claim 4, wherein the retrieval assembly further comprises a pair of life vessel supports mountable to the rail on opposed sides of the rail, wherein the life vessel is receivable between the supports and supported thereby when the life vessel is locked to the sled.

15. The system of any of claim 4, wherein the rail comprises:

a) an H-beam comprising a generally horizontal lower wall, at least one generally horizontal upper wall and at least one generally vertical connecting wall extending between the lower wall and the upper wall;

b) a T-beam extending from the H-beam, the T-beam comprising at least one generally vertical spacing wall extending upwardly from the upper wall, and at least one generally horizontal top wall extending from the spacing wall, the top wall defining a sled-support.

16. The system of claim 15, wherein the sled is seatable on the sled-support and slideable therealong.

17. The system of any of claim 15, wherein the sled comprises a base wall seatable on the sled-support, and a pair of stabilizer walls extending downwardly and from the base wall and inwardly between the upper wall and sled-support.

18. The system of claim 15, wherein an upper surface of the sled-support is coated with a low-friction material, optionally high density polyethylene.

19. A method for retrieving a life vessel and drawing the life vessel onto a deck of a rescue vessel, the rescue vessel comprising a retrieval assembly assembled to a deck thereof, the retrieval assembly comprising a fulcrum assembled to the deck of the rescue vessel proximate a stern of the rescue vessel, a rail comprising a first end portion and a second end portion, the rail mounted to the fulcrum and pivoted thereabout such that the first end of portion of the rail is positioned in water, and a sled mounted to the rail and positioned at the first end portion of the rail, the method comprising:

a) securing a tow-line between the life vessel and the rescue vessel by (a) deploying a tow-line from the life vessel into the water, the tow-line comprising a first end portion secured to the life vessel; (b) activating a pneumatic line-throwing gun to launch a grapnel from the rescue vessel towards the tow-line; and (c) pulling the grapnel back towards the rescue vessel while hooking the grapnel to the tow-line, b) towing the life vessel towards the sled and securing the life vessel to the sled;

c) towing the sled and the life vessel along the rail from the first end portion of the rail towards the second end portion of the rail; and d) pivoting the first end of the rail out of the water and the second end portion of the rail back towards the deck.

* * * * *